US010492973B2

(12) United States Patent
Drake

(10) Patent No.: US 10,492,973 B2
(45) Date of Patent: Dec. 3, 2019

(54) DUAL MODALITY PRONE SPINE PATIENT SUPPORT APPARATUSES

(71) Applicant: Allen Medical Systems, Inc., Batesville, IN (US)

(72) Inventor: Jesse S. Drake, Westborough, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 1022 days.

(21) Appl. No.: 14/969,123

(22) Filed: Dec. 15, 2015

(65) Prior Publication Data

US 2016/0193099 A1 Jul. 7, 2016

Related U.S. Application Data

(60) Provisional application No. 62/099,867, filed on Jan. 5, 2015.

(51) Int. Cl.
*A61G 13/12* (2006.01)
*A61G 13/04* (2006.01)
(Continued)

(52) U.S. Cl.
CPC ..... *A61G 13/122* (2013.01); *A61G 7/075* (2013.01); *A61G 13/0054* (2016.11);
(Continued)

(58) Field of Classification Search
CPC ..... A61G 7/002; A61G 7/005; A61G 7/008; A61G 7/012; A61G 7/015; A61G 7/018; A61G 7/075; A61G 7/0755; A61G 13/02; A61G 13/04; A61G 13/06; A61G 13/08; A61G 13/12; A61G 13/1205; A61G 13/121; A61G 13/122; A61G 13/123; A61G 13/1235; A61G 13/124; A61G 13/1245; A61G 13/125
(Continued)

(56) References Cited

U.S. PATENT DOCUMENTS 1,021,335 A 3/1912 Robinson
1,098,477 A 6/1914 Cashman
(Continued)

FOREIGN PATENT DOCUMENTS

DE 3438956 A1 5/1985
DE 4039907 A1 7/1991
(Continued)

*Primary Examiner* — Robert G Santos
(74) *Attorney, Agent, or Firm* — Barnes & Thornburg LLP

(57) ABSTRACT

A patient support apparatus for spine surgery includes first and second lift columns. A patient support frame extends between the first and second lift columns. The patient support frame has a first section to support a torso of a patient and a beam that extends from the first section. The beam is coupled to a foot end region of the first section about midway between opposite sides of the first section. A first set of leg supports are located adjacent a first side of the beam and a second set of leg supports are located adjacent a second side of the beam. The first and second sets of leg supports are independently movable relative to the beam and relative to the first section to support the legs of the patient in a plurality of positions.

20 Claims, 11 Drawing Sheets

(51) Int. Cl.

| | |
|---|---|
| ***A61G 13/08*** | (2006.01) |
| ***A61G 7/075*** | (2006.01) |
| ***A61G 7/015*** | (2006.01) |
| ***A61G 13/00*** | (2006.01) |

(52) U.S. Cl.
CPC ..... *A61G 13/04* (2013.01); *A61G 13/124* (2013.01); *A61G 13/125* (2013.01); *A61G 13/1245* (2013.01); *A61G 7/015* (2013.01); *A61G 13/08* (2013.01); *A61G 2200/325* (2013.01); *A61G 2210/10* (2013.01)

(58) Field of Classification Search
USPC ..... 5/621–624, 600, 607–610, 613, 616–618
See application file for complete search history.

(56) References Cited

U.S. PATENT DOCUMENTS 1,160,451 A 11/1915 Sanford
1,171,713 A 2/1916 Gilkerson
1,372,565 A 3/1921 Skelly
1,528,835 A 3/1925 McCollough
1,662,464 A 3/1928 McCutchen
1,799,692 A 4/1931 Knott
1,938,006 A 12/1933 Blanchard
2,103,693 A 12/1937 Pohl
2,188,592 A 1/1940 Cunningham
2,261,297 A 11/1941 Seib
2,337,505 A 12/1943 Swift
2,452,816 A 11/1948 Wagner
2,613,371 A 10/1952 Keyes, Jr.
2,636,793 A 4/1953 Meyer
2,667,169 A 1/1954 Kambourakis
2,688,410 A 9/1954 Nelson
2,691,979 A 10/1954 Watson
2,764,150 A 9/1956 Ettinger et al.
2,792,945 A 5/1957 Brenny
2,803,022 A 8/1957 Wynkoop
2,880,720 A 4/1959 Houghtaling
3,046,071 A 7/1962 Shampaine et al.
3,049,726 A 8/1962 Getz
3,090,381 A 5/1963 Watson
3,226,734 A 1/1966 Coventon
3,238,539 A 3/1966 Koch
3,281,141 A 10/1966 Smiley et al.
3,286,707 A 11/1966 Shafer
3,302,218 A 2/1967 Stryker
3,388,700 A 6/1968 Mountz
3,428,307 A 2/1969 Hunter et al.
3,434,165 A 3/1969 Keane
3,584,321 A 6/1971 Buchanan
3,599,964 A 8/1971 Magni et al.
3,640,416 A 2/1972 Temple
3,652,851 A 3/1972 Zaalberg
3,739,406 A 6/1973 Koetter
3,745,996 A 7/1973 Rush, Sr.
3,751,028 A 8/1973 Scheininger et al.
3,766,384 A 10/1973 Anderson
3,795,018 A 3/1974 Broaded
3,814,414 A 6/1974 Chapa
3,827,089 A 8/1974 Grow
3,832,742 A 9/1974 Stryker
3,859,982 A 1/1975 Dove
3,873,081 A 3/1975 Smith
3,895,403 A 7/1975 Davis
3,946,452 A 3/1976 Eary, Sr.
3,949,983 A 4/1976 Tommasino
3,988,790 A 11/1976 Mracek et al.
4,071,916 A 2/1978 Nelson
4,101,120 A 7/1978 Seshima
4,131,802 A 12/1978 Braden et al.
4,144,880 A 3/1979 Daniels
4,148,472 A 4/1979 Rais et al.
4,175,550 A 11/1979 Leininger et al.
4,186,917 A 2/1980 Rais et al.
4,227,269 A 10/1980 Johnston
4,239,039 A 12/1980 Thompson
4,244,358 A 1/1981 Pyers
4,257,407 A 3/1981 Macchi
4,356,577 A 11/1982 Taylor et al.
4,384,378 A 5/1983 Getz et al.
4,398,707 A 8/1983 Cloward
4,459,712 A 7/1984 Pathan
4,503,844 A 3/1985 Siczek
4,545,571 A 10/1985 Chambron
4,552,346 A 11/1985 Schnelle et al.
4,579,111 A 4/1986 Ledesma
4,658,450 A 4/1987 Thompson
4,712,781 A 12/1987 Watanabe
4,730,606 A 3/1988 Leininger
4,763,643 A 8/1988 Vrzalik
4,769,584 A 9/1988 Irigoyen et al.
4,771,785 A 9/1988 Duer
4,827,541 A 5/1989 Vollman et al.
4,840,362 A 6/1989 Bremer et al.
4,850,775 A 7/1989 Lee et al.
4,856,128 A 8/1989 Alsip et al.
4,866,796 A 9/1989 Robinson et al.
4,868,937 A 9/1989 Connolly
4,872,657 A 10/1989 Lüssi
4,887,325 A 12/1989 Tesch
4,924,537 A 5/1990 Alsip et al.
4,937,901 A 7/1990 Brennan
4,939,801 A 7/1990 Schaal et al.
4,944,054 A 7/1990 Bossert
4,944,500 A 7/1990 Mueller et al.
4,947,496 A 8/1990 Connolly
4,953,245 A 9/1990 Jung
4,970,737 A 11/1990 Sagel
5,020,170 A 6/1991 Ruf
5,088,706 A 2/1992 Jackson
5,131,106 A 7/1992 Jackson
5,152,024 A 10/1992 Chrones et al.
5,161,267 A 11/1992 Smith
5,181,289 A 1/1993 Kassai
5,210,887 A 5/1993 Kershaw
5,210,888 A 5/1993 Canfield
5,231,741 A 8/1993 Maguire
5,239,716 A 8/1993 Fisk
5,274,862 A 1/1994 Palmer, Jr. et al.
5,333,334 A 8/1994 Kassai
5,393,018 A 2/1995 Roth et al.
5,404,603 A 4/1995 Fukai et al.
5,444,882 A 8/1995 Andrews et al.
5,461,740 A 10/1995 Pearson
5,483,323 A 1/1996 Matsuda et al.
5,487,195 A 1/1996 Ray
5,499,408 A 3/1996 Nix
5,502,853 A 4/1996 Singleton et al.
5,524,304 A 6/1996 Shutes
5,544,371 A 8/1996 Fuller
5,579,550 A 12/1996 Bathrick et al.
5,588,705 A 12/1996 Chang
5,613,254 A 3/1997 Clayman et al.
5,658,315 A 8/1997 Lamb et al.
5,673,443 A 10/1997 Marmor
5,737,781 A 4/1998 Votel
5,775,334 A 7/1998 Lamb et al.
5,778,467 A 7/1998 Scott et al.
5,794,286 A 8/1998 Scott et al.
5,890,238 A 4/1999 Votel
5,901,388 A 5/1999 Cowan
5,926,871 A 7/1999 Howard
5,937,467 A 8/1999 Kim
5,950,259 A 9/1999 Boggs
6,003,174 A 12/1999 Kantrowitz et al.
6,035,465 A 3/2000 Rogozinski
6,042,558 A 3/2000 Hoyne et al.
6,049,923 A 4/2000 Ochiai
6,076,525 A 6/2000 Hoffman
6,094,760 A 8/2000 Nonaka et al.
6,108,838 A 8/2000 Connolly et al.
6,112,349 A 9/2000 Connolly
6,154,901 A 12/2000 Carr

(56) References Cited

U.S. PATENT DOCUMENTS 6,230,342 B1 5/2001 Haugs
6,260,220 B1 7/2001 Lamb et al.
6,282,736 B1 9/2001 Hand et al.
6,286,164 B1 9/2001 Lamb et al.
6,295,671 B1 10/2001 Reesby et al.
6,311,349 B1 11/2001 Kazakia et al.
6,315,564 B1 11/2001 Levisman
6,324,710 B1 12/2001 Hernandez et al.
6,385,801 B1 5/2002 Watanabe et al.
6,421,854 B1 7/2002 Heimbrock
6,438,777 B1 8/2002 Bender
6,496,991 B1 12/2002 Votel
6,499,158 B1 12/2002 Easterling
6,499,160 B2 12/2002 Hand et al.
6,505,365 B1 1/2003 Hanson et al.
6,523,197 B2 2/2003 Zitzmann
6,526,610 B1 3/2003 Hand et al.
6,584,630 B1 7/2003 Dinkler
6,609,260 B2 8/2003 Hand et al.
6,615,430 B2 9/2003 Heimbrock
6,622,324 B2 9/2003 VanSteenburg et al.
6,634,043 B2 10/2003 Lamb et al.
6,637,058 B1 10/2003 Lamb
6,638,299 B2 10/2003 Cox
6,662,388 B2 12/2003 Friel et al.
6,662,391 B2 12/2003 Wilson et al.
6,668,396 B2 12/2003 Wei
6,671,904 B2 1/2004 Easterling
6,681,423 B2 1/2004 Zachrisson
6,691,347 B2 2/2004 Hand et al.
6,701,553 B1 3/2004 Hand et al.
6,701,554 B2 3/2004 Heimbrock
6,721,976 B2 4/2004 Schwaegerle
6,813,788 B2 11/2004 Dinkler et al.
6,817,363 B2 11/2004 Biondo et al.
6,854,137 B2 2/2005 Johnson
6,857,144 B1 2/2005 Huang
6,859,967 B2 3/2005 Harrison et al.
6,862,759 B2 3/2005 Hand et al.
6,862,761 B2 3/2005 Hand et al.
6,874,181 B1 4/2005 Connolly et al.
6,886,199 B1 5/2005 Schwaegerle
6,898,811 B2 5/2005 Zucker et al.
6,912,959 B2 7/2005 Kolody et al.
6,928,676 B1 8/2005 Schwaegerle
6,941,951 B2 9/2005 Hubert et al.
6,966,081 B1 11/2005 Sharps et al.
6,971,997 B1 12/2005 Ryan et al.
6,986,179 B2 1/2006 Varadharajulu et al.
7,020,917 B1 4/2006 Kolody et al.
7,080,422 B2 7/2006 Ben-Levi
7,086,103 B2 8/2006 Barthelt
7,089,612 B2 8/2006 Rocher et al.
7,089,884 B2 8/2006 Wang et al.
7,103,932 B1 9/2006 Kandora
7,137,160 B2 11/2006 Hand et al.
7,152,261 B2 12/2006 Jackson
7,171,709 B2 2/2007 Weismiller
7,197,778 B2 4/2007 Sharps
7,214,138 B1 5/2007 Stivers et al.
7,216,385 B2 5/2007 Hill
7,234,180 B2 6/2007 Horton et al.
7,290,302 B2 11/2007 Sharps
7,343,635 B2 3/2008 Jackson
7,343,916 B2 3/2008 Biondo et al.
7,496,980 B2 3/2009 Sharps
7,520,007 B2 4/2009 Skripps
7,520,008 B2 4/2009 Wong et al.
7,565,708 B2 7/2009 Jackson
7,600,281 B2 10/2009 Skripps
7,653,953 B2 2/2010 Lopez-Sansalvador
7,669,262 B2 3/2010 Skripps et al.
7,681,269 B2 3/2010 Biggie et al.
7,694,369 B2 4/2010 Hinders et al.
7,739,762 B2 6/2010 Lamb et al.
7,810,185 B2 10/2010 Bürstner et al.
7,824,353 B2 11/2010 Matta
7,861,720 B1 1/2011 Wolcott
7,882,583 B2 2/2011 Skripps
7,931,607 B2 4/2011 Biondo et al.
7,954,996 B2 6/2011 Boomgaarden et al.
D645,967 S 9/2011 Sharps
8,020,227 B2 9/2011 Dimmer et al.
8,042,208 B2 10/2011 Gilbert et al.
8,056,163 B2 11/2011 Lemire et al.
8,060,960 B2 11/2011 Jackson
8,118,029 B2 2/2012 Gneiting et al.
D663,427 S 7/2012 Sharps
D665,912 S 8/2012 Skripps
8,234,730 B2 8/2012 Skripps
8,234,731 B2 8/2012 Skripps
8,256,050 B2 9/2012 Wong et al.
8,286,283 B2 10/2012 Copeland et al.
D676,971 S 2/2013 Sharps
8,381,331 B2 2/2013 Sharps et al.
8,397,323 B2 3/2013 Skripps et al.
D683,032 S 5/2013 Sharps
8,464,375 B1 6/2013 Jorgensen et al.
8,486,068 B2 7/2013 Starr
8,555,439 B2 10/2013 Soto et al.
8,584,281 B2 11/2013 Diel et al.
8,590,074 B2 11/2013 Hornbach et al.
8,635,725 B2 1/2014 Tannoury et al.
8,676,293 B2 3/2014 Breen et al.
8,677,529 B2 3/2014 Jackson
8,707,476 B2 4/2014 Sharps
8,707,484 B2 4/2014 Jackson et al.
8,719,979 B2 5/2014 Jackson
8,732,876 B2 5/2014 Lachenbruch et al.
8,763,178 B1 7/2014 Martin et al.
8,777,878 B2 7/2014 Deitz
8,782,832 B2 7/2014 Blyakher et al.
8,806,679 B2 8/2014 Soto et al.
8,826,474 B2 9/2014 Jackson
8,826,475 B2 9/2014 Jackson
8,833,707 B2 9/2014 Steinberg et al.
8,839,471 B2 9/2014 Jackson
8,844,077 B2 9/2014 Jackson et al.
8,845,264 B2 9/2014 Kubiak et al.
8,856,986 B2 10/2014 Jackson
8,864,205 B2 10/2014 Lemire et al.
8,893,333 B2 11/2014 Soto et al.
D720,076 S 12/2014 Sharps et al.
8,938,826 B2 1/2015 Jackson
8,978,180 B2 3/2015 Jackson
8,997,286 B2 4/2015 Wyslucha et al.
9,072,646 B2 * 7/2015 Skripps ..... A61G 13/04
9,119,610 B2 9/2015 Matta et al.
9,180,062 B2 * 11/2015 Jackson ..... A61G 7/001
9,186,291 B2 * 11/2015 Jackson ..... A61G 13/04
9,198,817 B2 * 12/2015 Jackson ..... A61G 7/001
9,205,013 B2 * 12/2015 Jackson ..... A61G 7/001
9,211,223 B2 * 12/2015 Jackson ..... A61G 7/001
9,226,865 B2 * 1/2016 Jackson ..... A61G 13/0036
9,233,037 B2 1/2016 Sharps et al.
9,265,679 B2 * 2/2016 Jackson ..... A61G 13/08
9,265,680 B2 * 2/2016 Sharps ..... A61G 13/04
9,289,342 B2 * 3/2016 Jackson ..... A61G 7/001
9,295,433 B2 * 3/2016 Jackson ..... A61B 6/0407
9,301,897 B2 * 4/2016 Jackson ..... A61G 13/08
9,308,145 B2 * 4/2016 Jackson ..... A61G 7/001
9,339,430 B2 * 5/2016 Jackson ..... A61G 13/0036
9,358,170 B2 * 6/2016 Jackson ..... A61G 13/08
9,364,380 B2 * 6/2016 Jackson ..... A61G 7/001
9,402,775 B2 * 8/2016 Jackson ..... A61G 13/02
9,414,982 B2 * 8/2016 Jackson ..... A61G 13/08
9,456,945 B2 * 10/2016 Jackson ..... A61G 7/001
9,468,576 B2 * 10/2016 Jackson ..... A61G 13/08
9,474,671 B2 * 10/2016 Sharps ..... A61G 13/04
9,498,397 B2 * 11/2016 Hight ..... A61G 13/04
9,504,622 B2 * 11/2016 Jackson ..... A61G 13/04
9,510,987 B2 * 12/2016 Jackson ..... A61G 13/04
9,549,863 B2 * 1/2017 Jackson ..... A61G 13/06
9,561,145 B2 * 2/2017 Jackson ..... A61G 13/0036

(56) References Cited

U.S. PATENT DOCUMENTS 9,572,734 B2 * 2/2017 Jackson ..... A61G 13/0036
9,610,206 B2 * 4/2017 Jackson ..... A61G 7/001
9,622,928 B2 * 4/2017 Jackson ..... A61G 13/06
9,629,766 B2 * 4/2017 Jackson ..... A61G 13/06
9,636,266 B2 * 5/2017 Jackson ..... A61B 6/0407
9,642,760 B2 * 5/2017 Jackson ..... A61G 13/04
9,687,399 B2 * 6/2017 Jackson ..... A61G 13/0036
9,700,476 B2 * 7/2017 Hoel ..... A61G 13/10
9,744,087 B2 * 8/2017 Jackson ..... A61G 7/015
9,744,089 B2 * 8/2017 Jackson ..... A61G 13/08
9,757,299 B2 * 9/2017 Hight ..... A61G 13/04
9,757,300 B2 * 9/2017 Jackson ..... A61G 7/001
9,849,054 B2 * 12/2017 Jackson ..... A61G 13/0036
9,877,883 B2 * 1/2018 Jackson ..... A61G 13/0036
9,889,054 B2 * 2/2018 Jackson ..... A61G 13/0036
9,937,006 B2 * 4/2018 Skripps ..... A61G 13/04
9,937,094 B2 * 4/2018 Jackson ..... A61G 13/04
9,968,503 B2 * 5/2018 Hight ..... A61G 13/04
9,993,380 B2 * 6/2018 Jackson ..... A61G 13/08
10,149,793 B2 * 12/2018 Hoel ..... A61G 13/04
10,159,618 B2 * 12/2018 Jackson ..... A61G 13/04
10,299,977 B2 * 5/2019 Fakhrizadeh ..... A61G 7/005
2004/0133983 A1 7/2004 Newkirk et al.
2005/0155149 A1 7/2005 Pedersen
2005/0235415 A1 10/2005 Pedersen et al.
2006/0123552 A1 6/2006 Ben-Levi
2008/0000028 A1 1/2008 Lemire et al.
2009/0126116 A1 5/2009 Lamb et al.
2009/0205139 A1 8/2009 Van Deursen et al.
2010/0192300 A1 8/2010 Tannoury et al.
2011/0099716 A1 * 5/2011 Jackson ..... A61G 13/0036 5/607
2011/0107516 A1 5/2011 Jackson et al.
2011/0107517 A1 * 5/2011 Lamb ..... A61G 13/08 5/617
2012/0023672 A1 * 2/2012 Jackson ..... A61G 7/001 5/610
2012/0144589 A1 * 6/2012 Skripps ..... A61G 13/04 5/624
2012/0198625 A1 8/2012 Jackson
2012/0246829 A1 * 10/2012 Lamb ..... A61G 13/08 5/617
2012/0255122 A1 * 10/2012 Diel ..... A61G 13/0036 5/610
2013/0111666 A1 5/2013 Jackson
2013/0117938 A1 * 5/2013 Lamb ..... A61G 13/08 5/617
2013/0133137 A1 * 5/2013 Jackson ..... A61G 13/08 5/617
2013/0198958 A1 * 8/2013 Jackson ..... A61G 13/0036 5/607
2013/0205500 A1 8/2013 Jackson
2013/0219623 A1 8/2013 Jackson
2013/0254992 A1 * 10/2013 Jackson ..... A61G 7/001 5/607
2013/0254993 A1 * 10/2013 Jackson ..... A61G 7/001 5/607
2013/0254994 A1 * 10/2013 Jackson ..... A61G 7/001 5/607
2013/0254995 A1 10/2013 Jackson
2013/0254996 A1 10/2013 Jackson
2013/0254997 A1 10/2013 Jackson
2013/0269710 A1 10/2013 Hight et al.
2013/0312181 A1 11/2013 Jackson et al.
2013/0312182 A1 * 11/2013 Jackson ..... A61G 7/001 5/607
2013/0312187 A1 11/2013 Jackson
2013/0312188 A1 11/2013 Jackson
2013/0318718 A1 * 12/2013 Jackson ..... A61G 7/001 5/607
2013/0318719 A1 * 12/2013 Jackson ..... A61G 7/001 5/608
2013/0326812 A1 * 12/2013 Jackson ..... A61G 7/001 5/607
2013/0326813 A1 12/2013 Jackson
2014/0007349 A1 1/2014 Jackson
2014/0020181 A1 1/2014 Jackson
2014/0033434 A1 * 2/2014 Jackson ..... A61G 13/04 5/607
2014/0033436 A1 2/2014 Jackson
2014/0068861 A1 3/2014 Jackson et al.
2014/0082842 A1 3/2014 Jackson
2014/0109316 A1 4/2014 Jackson et al.
2014/0137327 A1 * 5/2014 Tannoury ..... A61G 13/0036 5/607
2014/0150178 A1 * 6/2014 Sharps ..... A61G 7/001 5/86.1
2014/0173826 A1 6/2014 Jackson
2014/0196212 A1 7/2014 Jackson
2014/0201913 A1 7/2014 Jackson
2014/0201914 A1 7/2014 Jackson
2014/0208512 A1 7/2014 Jackson
2014/0250598 A1 * 9/2014 Sharps ..... A61G 13/04 5/608
2014/0317847 A1 10/2014 Jackson
2014/0359941 A1 * 12/2014 Sharps ..... A61G 13/04 5/610
2015/0059094 A1 3/2015 Jackson
2015/0113733 A1 * 4/2015 Diel ..... A61G 13/04 5/610
2015/0150743 A1 6/2015 Jackson
2015/0202106 A1 * 7/2015 Hight ..... A61G 13/04 602/36
2015/0245969 A1 * 9/2015 Hight ..... A61G 13/04 5/600
2015/0272681 A1 * 10/2015 Skripps ..... A61G 13/04 128/854
2015/0328075 A9 * 11/2015 Sharps ..... A61G 13/04 5/608
2016/0000621 A1 1/2016 Jackson et al.
2016/0000626 A1 1/2016 Jackson et al.
2016/0000627 A1 1/2016 Jackson et al.
2016/0000629 A1 1/2016 Jackson et al.
2016/0008201 A1 * 1/2016 Jackson ..... A61G 13/04 128/845
2016/0038364 A1 * 2/2016 Jackson ..... A61G 7/001 5/608
2016/0136027 A1 * 5/2016 Jackson ..... A61G 13/08 5/617
2016/0166452 A1 * 6/2016 Jackson ..... A61B 6/0407 5/601
2016/0193099 A1 * 7/2016 Drake ..... A61G 13/1245 5/624
2016/0213542 A1 * 7/2016 Jackson ..... A61G 7/001
2016/0220437 A1 * 8/2016 Hoel ..... A61G 13/04
2016/0228316 A1 * 8/2016 Hoel ..... A61G 13/10
2016/0296393 A1 * 10/2016 Jackson ..... A61G 13/0036
2016/0296395 A1 * 10/2016 Jackson ..... A61G 13/0036
2016/0317372 A1 * 11/2016 Jackson ..... A61G 13/08
2016/0317373 A1 * 11/2016 Jackson ..... A61G 13/02
2016/0324706 A9 * 11/2016 Jackson ..... A61G 7/015
2016/0331615 A1 * 11/2016 Fakhrizadeh ..... A61G 7/005
2016/0346148 A1 * 12/2016 Jackson ..... A61G 13/0036
2016/0346149 A1 * 12/2016 Jackson ..... A61G 13/0036
2017/0071809 A1 * 3/2017 Jackson ..... A61G 13/04
2017/0151114 A9 * 6/2017 Jackson ..... A61G 13/04
2017/0151115 A1 * 6/2017 Jackson ..... A61G 7/001
2017/0181908 A1 * 6/2017 Jackson ..... A61G 13/04
2017/0189254 A1 * 7/2017 Jackson ..... A61B 6/0407
2017/0202523 A1 * 7/2017 Jackson ..... A61B 6/0407
2017/0209325 A1 * 7/2017 Jackson ..... A61G 13/06
2017/0319411 A1 * 11/2017 Jackson ..... A61G 13/0054
2017/0333276 A1 * 11/2017 Jackson ..... A61G 13/08
2017/0348171 A1 * 12/2017 Jackson ..... A61G 7/001
2018/0036193 A1 * 2/2018 Jackson ..... A61G 13/04
2018/0133078 A1 * 5/2018 Jackson ..... A61G 13/0036
2018/0140488 A1 * 5/2018 Jackson ..... A61G 13/0036
2019/0117491 A1 * 4/2019 Jackson ..... A61G 13/04

(56) References Cited

U.S. PATENT DOCUMENTS

FOREIGN PATENT DOCUMENTS

| | | | |
|---|---|---|---|
| DE | 4429062 | A1 | 2/1996 |
| DE | 19723927 | A1 | 12/1998 |
| DE | 10158470 | A1 | 6/2003 |
| EP | 0617947 | A1 | 10/1994 |
| EP | 1159947 | A2 | 12/2001 |
| EP | 1210049 | A1 | 6/2002 |
| EP | 1686944 | A1 | 8/2006 |
| EP | 1982680 | A1 | 10/2008 |
| FR | 2247194 | A1 | 5/1975 |
| GB | 2210554 | A | 6/1989 |
| JP | 2001112582 | A | 4/2001 |
| WO | WO 85/00967 | | 3/1985 |
| WO | WO 86/00221 | | 1/1986 |
| WO | WO 99/53997 | A1 | 10/1999 |
| WO | WO 02/05740 | A2 | 1/2002 |
| WO | WO 03/096958 | | 11/2003 |
| WO | WO 2004/026212 | A1 | 4/2004 |
| WO | WO 2006/006106 | A1 | 1/2006 |
| WO | WO 2006/061606 | A1 | 6/2006 |
| WO | WO 2009/071787 | A3 | 6/2009 |

* cited by examiner

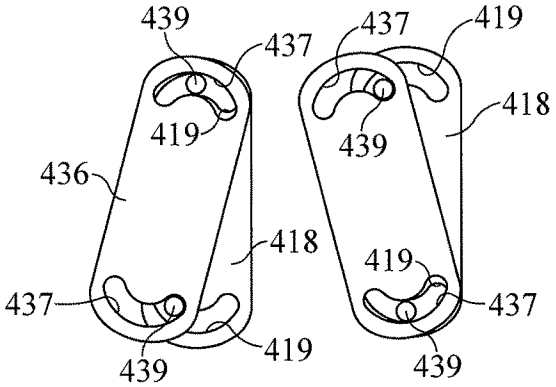
FIG. 11A
FIG. 11B
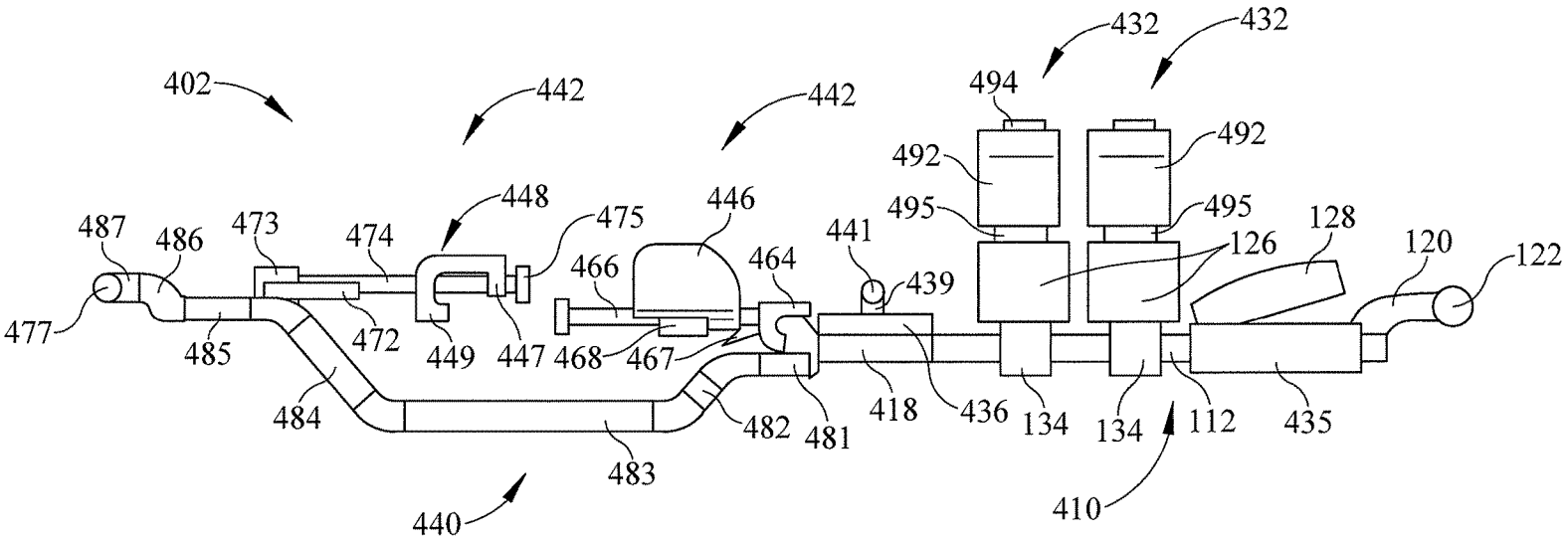
FIG. 10

DUAL MODALITY PRONE SPINE PATIENT SUPPORT APPARATUSES

The present application claims the benefit, under 35 U.S.C. § 119(e), of U.S. Provisional Application No. 62/099,867, which was filed Jan. 5, 2015, and which is hereby incorporated by reference herein in its entirety.

BACKGROUND

The present disclosure relates to patient support apparatuses and particularly, to surgical support apparatuses used during spine surgery. More particularly, the present disclosure relates to dual modality prone spine patient support apparatuses that are used to perform spine surgery on patients in prone positions and lateral positions.

Some patient support apparatuses used for spine surgery have movable table tops that are configured to support patients in a prone position and in a lateral position. See, for example, U.S. Patent Application Publication No. 2012/0144589 A1 in this regard. Some spine surgery support apparatuses have table top frames that are supported by vertical columns at the ends of the table top frame with the table top frame being hinged in the vicinity of a patient's pelvic region to permit various patient positions to be achieved. See, for example, U.S. Pat. Nos. 7,152,261; 7,343,635; 7,565,708; and 8,060,960 as well as U.S. Patent Application Publication No. 2014/0007349 A1 in this regard.

In many of these prior art spine surgery table top frames, both of the patient's legs are supported by a flat panel when the patient is in a prone position and sometimes, even when in a lateral position. In U.S. Patent Application Publication No. 2014/0068861 A1, one or more leg support slings are used rather than a flat panel, but the slings support both of the patient's legs in a similar position. In U.S. Pat. No. 7,152,261, separate leg support panels are provided but each flat panel supports the patient's entire respective leg, and when the patient is rolled into a lateral position, a separate leg support accessory is attached to the spine surgery table in some instances to support one of the patient's legs. Accordingly, surgeons using spine surgery apparatuses of the type having a table top frame supported between lift columns may appreciate a patient support apparatus having the capability to support a patient's legs in a wider variety of positions than afforded by the known prior art patient support apparatuses of this type. Being able to use the same leg supports when the patient is in a prone position and in a lateral position without the need to separately attach further accessories will also be appreciated.

SUMMARY

The present disclosure includes various embodiments each having one or more of the features recited in the appended claims and/or the following features which each are considered to be optional and which, alone or in any combination, may comprise patentable subject matter:

According to the present disclosure, a patient support apparatus for spine surgery may include a first lift column and a second lift column that may be spaced apart from the first lift column in a longitudinal dimension of the patient support apparatus. A patient support frame may extend longitudinally between the first and second lift columns. The patient support frame may comprise a first section to support a torso of a patient. The first section may have spaced apart first and second rails extending parallel with the longitudinal dimension of the patient support apparatus. The first section may have a head end region coupled to the first lift column by a first coupling assembly. The patient support frame may have a beam that extends from the first section and that couples to the second lift column by a second coupling assembly. The beam may be coupled to a foot end region of the first section about midway between opposite sides of the first section.

The patient support apparatus may also have a first set of leg supports that may be located adjacent a first side of the beam. The first set of leg supports may be movable relative to the beam and relative to the first section of the patient support frame to support a first leg of the patient in a plurality of positions. A second set of leg supports may be located adjacent a second side of the beam opposite to the first side. The second set of leg supports may be movable relative to the beam and relative to the first section of the support frame to support a second leg of the patient in a plurality of positions.

In some embodiments, the first set of leg supports may include a thigh support that may be pivotably coupled to a foot end region of the first section of the patient support frame and an ankle support that may be slidably coupled to the beam of the patient support frame. The thigh support may include a curved thigh cradle and the ankle support may include a generally cylindrical pad in some embodiments. In some embodiments, a first set of straps may be coupled to the first set of leg supports. The first set of straps may be usable to secure the first leg of the patient to the first set of leg supports.

In some embodiments, the thigh support may include a support rod having a first end that may be coupled to the foot end region of the first section for pivoting movement about a first axis that may be oriented in substantially perpendicular relation with the beam. In some such embodiments, the thigh support may include a second rod that may extend and retract relative to the first rod along a second axis that may be substantially perpendicular to the first axis. The thigh support may include a thigh support pad that may be coupled to the second rod and that may be rotatable about the second axis. In some embodiments, the ankle support may extend laterally from the beam and may be supported relative to the beam in a cantilevered manner.

According to this disclosure, the second coupling assembly may include an arced member that may support a foot end of the beam. A head end of the beam may be pivotably coupled to a foot end region of the first section for pivoting movement about an axis that may be oriented substantially vertically when the patient support frame is oriented horizontally so that the patient is supported on the patient support frame in a prone position. The foot end of the beam may travel along the arced member as the beam pivots about the axis. In some embodiments, the arced member may include an arced track and the foot end of the beam may be received within the arced track.

Optionally, the arced member may include an arced rack that may have a first set of teeth. A pinion may be coupled to the foot end of the beam and may have a second set of teeth that may interface with the first set of teeth. The pinion may be rotatable to move the foot end of the beam along the arced member. If desired, a handle may be coupled to the pinion and the handle may be manually rotatable to rotate the pinion to move the foot end of the beam along the arced member.

According to this disclosure, the patient support apparatus may further have a set of torso supports that may be coupled to at least one of the first and second rails. The patient support apparatus may also have a pair of lateral supports that may be coupled to at least one of the first and second rails. In some embodiments, each lateral support of the pair of lateral supports may extend upwardly beyond upper surfaces of the torso supports when the patient is supported on the torso supports in a prone position. The lateral supports may support a side of the patient's torso when the patient support frame is rotated by about 90 degrees with respect to the first and second lift columns to place the patient in a lateral position. The pair of lateral supports each may include a first support portion that may couple to one of the first and second rails and a second support portion that may adjustably move toward and away from the first support portion to accommodate patients of different sizes.

In some embodiments, the first section of the patient support frame may include a foot end frame member that may extend laterally. The patient support apparatus may further include a hip support that may be supported with respect to the foot end frame member. For example, the hip support may be coupled to the foot end frame member for pivoting movement about a first axis that may be oriented substantially vertically when the patient support frame is oriented horizontally so that the patient is supported on the patient support frame in a prone position. In some embodiments, the beam is also pivotable about the first axis although this need not be the case. For example, the beam may be pivotable relative to the first section about a second axis that may be spaced from and parallel with the first axis.

In some embodiments, a hip support may be supported with respect to the foot end frame member and the hip support may have first and second arced slots formed in respective first and second end regions adjacent corresponding first and second sides of the first section. In such embodiments, the patient support apparatus may include posts that may extend through the slots to retain the hip support in place relative to the foot end frame member while permitting pivoting movement of the hip support with respect to the foot end frame member. This may be referred to as a squirkle pivot according to this disclosure.

According to another aspect of the present disclosure, a patient support apparatus for spine surgery may include a first lift column and a second lift column that may be spaced apart from the first lift column in a longitudinal dimension of the patient support apparatus. A patient support frame may extend longitudinally between the first and second lift columns. The patient support frame may include a first section to support a torso of a patient. The first section may have spaced apart first and second rails extending parallel with the longitudinal dimension of the patient support apparatus. The first section having a head end region coupled to the first lift column by a first coupling assembly. The patient support frame may have a first beam that may extend from the first section and that may couple to the second lift column by a second coupling assembly. The beam may be coupled to a foot end region of the first section about midway between opposite sides of the first section.

The patient support apparatus may include a first leg support strut that may be coupled to the foot end region of the first section and that may be located adjacent a first side of the beam. The patient support apparatus may further include a second leg support strut that may be coupled to the foot end region of the first section and that may be located adjacent a second side of the beam opposite to the first side. A first set of leg support pads may be coupled to the first leg support strut. In some embodiments, the first set of leg support pads may include a first thigh pad and a first ankle pad. A second set of leg support pads may be coupled to the second leg support strut. In some embodiments, the second set of leg support pads may include a second thigh pad and a second ankle pad.

In some embodiments, the patient support apparatus may further include a second beam that may extend from the second coupling assembly in a cantilevered manner so as to terminate at a free end that may be spaced from the first section of the patient support frame. The second beam may be situated above the first beam. The first and second ankle pads may be supported by the second beam on respective first and second sides thereof. For example, the first and second ankle pads may extend laterally from respective first and second sides of the second beam and each may be supported relative to the second beam in a cantilevered manner. In some embodiments, the second beam may have first and second slots along the first and second sides and the first and second ankle pads each may have a respective support post that may extend into the respective first and second slot. The first and second ankle pads each may be independently adjustable along a length of the second beam.

In some embodiments, when the patient support frame is in a horizontal position supporting the patient in a prone position, the first beam may include a first segment that may angle downwardly with respect to the foot end region of the first section, a second segment that may extend horizontally from a lower end of the first segment, and a third segment that may angle upwardly from the second segment to the second coupling assembly. The second coupling assembly may include an arced member that may support the foot end regions of the first and second beams. The patient support frame may include a first laterally extending member and a second laterally extending member that may be coupled to the first laterally extending member for pivoting movement about an axis. The first segment of the first beam may be coupled to the second laterally extending member. The foot end regions of the first and second beams may travel along the arced member as the beam pivots with the second laterally extending member about the axis. The first and second laterally extending members may serve as a hip support for the patient supported by the patient support frame in a prone position.

In some embodiments, at least one of the first and second struts may include a first strut portion and a second strut portion that may articulate at a joint relative to the first strut portion. The thigh pad may be coupled to the first strut portion and the ankle pad may be coupled to the second strut portion. In some embodiments, the patient support apparatus may further include a knee pad that may be coupled to at least one of the first and second struts adjacent the joint.

Alternatively or additionally, at least one of the first and second struts may include a first strut portion and a second strut portion that may telescopically extend and retract relative to the first strut portion. In such embodiments, the thigh pad may be coupled to the first strut portion and the ankle pad may be coupled to the second strut portion. A knee pad may be coupled to at least one of the first and second struts between the respective thigh and ankle pads in the telescoping strut embodiment.

In some embodiments, the patient support apparatus may further include a set of torso supports that may be coupled to one of the first and second rails and a pair of lateral supports that may be coupled to the other of the first and second rails. Each lateral support of the pair of lateral supports may extend upwardly beyond upper surfaces of the torso supports when the patient is supported on the torso supports in a prone position. The lateral supports may support a side of the patient's torso when the patient support frame is rotated with respect to the first and second lift columns to place the patient in a lateral position. The pair of lateral supports each may include a first support portion that may couple to one of the first and second rails and a second support portion that may adjustably move toward and away from the first support portion to accommodate patients of different sizes.

According to a further aspect of the present disclosure, a patient support apparatus for spine surgery may include a first lift column and a second lift column spaced apart from the first lift column in a longitudinal dimension of the patient support apparatus. A patient support frame may extend longitudinally between the first and second lift columns. The patient support frame may have a first section to support a torso of a patient. The first section may have spaced apart first and second rails that may extend parallel with the longitudinal dimension of the patient support apparatus. The first section may have a head end region that may be coupled to the first lift column by a first coupling assembly. The patient support frame may also have a beam that may extend from the first section and that may couple to the second lift column by a second coupling assembly. The beam may be coupled to a foot end region of the first section about midway between opposite sides of the first section.

The patient support apparatus may have a first thigh support that may be coupled to a foot end region of the first section adjacent a first side of the beam and a second thigh support that may be coupled to the foot end region of the first section adjacent a second side of the beam opposite to the first side. An arced rail may be supported on the beam. The patient support apparatus may have first and second rods that may be coupled to the arced rail and that may be movable along the arced rail. First and second ankle supports may be coupled to the respective first and second rods.

In some embodiments, each of the first and second ankle supports may include a first portion that may be configured to engage a patient's shin and a second portion that may be configured to engage a top of the patient's foot. The first and second portions of each of the first and second ankle supports each may have a concave patient-engaging surface, if desired. Each of the first and second ankle supports may be repositionable along the respective first and second rods.

In some embodiments, the first and second thigh supports each may include a U-shaped thigh support surface. Alternatively or additionally, the first and second thigh supports each may have a notch configured to receive a patient's knee cap. In some embodiments, the patient support frame may have a first cylindrical bar that may be mounted to the foot end region of the first section adjacent a first side of the beam and a second cylindrical bar that may be mounted to the foot end region of the first section adjacent a second side of the beam. The first thigh support may have a first clamp that may releasably clamp onto the first cylindrical bar and the second thigh support may have a second clamp that may releasably clamp onto the second cylindrical bar. The first thigh support may have a first trigger that may be moved to release the first clamp from clamping onto the first bar so that the first thigh support may be rotatable about the first bar and the second thigh support may have a second trigger that may be moved to release the second clamp from clamping onto the second bar so that the second thigh support may be rotatable about the second bar.

In some embodiments, the first thigh support may include a third rod that may extend from the first clamp and a first thigh support cradle that may be releasably coupled to the third rod and the second thigh support may include a fourth rod that may extend from the second clamp and a second thigh support cradle that may be releasably coupled to the fourth rod. The first thigh support cradle may be repositionable along the third rod and the second thigh support cradle may be repositionable along the fourth rod.

In some embodiments, a set of torso supports may be coupled to one of the first and second rails and a pair of lateral supports may be coupled to the other of the first and second rails. Each lateral support of the pair of lateral supports may extend upwardly beyond upper surfaces of the torso supports when the patient is supported on the torso supports in a prone position. The lateral supports may support a side of the patient's torso when the patient support frame is rotated with respect to the first and second lift columns to place the patient in a lateral position. The pair of lateral supports each may include a first support portion that may couple to one of the first and second rails and a second support portion that may adjustably move toward and away from the first support portion to accommodate patients of different sizes.

In some embodiments, the first and second coupling assemblies each may include an H-bracket that each may have a central member, a first pair of legs that may extend away from the central member in a first direction, and a second pair of legs that may extend away from the central member in a second direction opposite to the first direction. The patient support frame may be attached to the first pair of legs of each H-bracket. The patient support apparatus may further include a pair of turn assist handles. Each turn assist handle may be coupled to the second pair of legs of the respective H-bracket. The pair of turn assist handles may be grippable by one or more caregivers to rotate the patient support frame relative to the first and second columns between a first orientation supporting the patient in a prone position and a second orientation supporting the patient in a lateral position.

In some embodiments, the foot end region of the first section of the patient support frame may include a foot end frame member that may extend laterally. A hip support may be supported with respect to the foot end frame member. The hip support may have a first arced slot that may be formed in a first end region of the hip support adjacent a first side of the patient support frame. The hip support may have a second arced slot that may be formed in a second end region of the hip support adjacent a second side of the patient support frame.

The patient support frame may include first and second posts that each may extend through the respective first and second slots and that each may be coupled to the foot end frame member. The first and second posts may be movable to lock the hip support in place relative to the foot end frame member and to release the hip support for pivoting movement relative to the foot end frame member. The first and second posts may cooperate with the first and second slots to define the pivoting movement of the hip support relative to the first frame member. In some embodiments, the first and second posts may be bent at their upper ends to provide release handles that may be gripped by a caregiver to release the hip support for pivoting movement relative to the foot end frame member.

According to yet another aspect of the present disclosure, a patient support apparatus for spine surgery may include a first lift column and a second lift column spaced apart from the first lift column in a longitudinal dimension of the patient support apparatus. A patient support frame may extend longitudinally between the first and second lift columns. The patient support frame may include a first section to support a torso of a patient. The first section may have spaced apart first and second rails that may extend parallel with the longitudinal dimension of the patient support apparatus. The first section may have a head end region that may be coupled to the first lift column by a first coupling assembly. The patient support frame may have a beam that may extend from the first section and that may couple to the second lift column by a second coupling assembly. The beam may be coupled to a foot end region of the first section about midway between opposite sides of the first section.

The patient support apparatus may further have a pad support beam that may extend between the first and second coupling assemblies in spaced apart relation with the patient support frame. The patient support apparatus may also have a set of lateral pads. Each lateral pad may include a first portion that may be coupled to the first section of the patient support frame and that may extend toward the pad support beam. Each lateral pad may also include a second portion that may be coupled to the pad support beam and that may extend toward the patient support frame.

In some embodiments, the first portion of each lateral pad may include a first cutout and a first protrusion and the second portion of each lateral pad may include a second cutout and a second protrusion. The first protrusion may extend into a space defined by the second cutout and the second protrusion may extend into a space defined by the first cutout. Thus, when the patient support frame is oriented to support a patient in a prone position, the second portion of each lateral pad may include a downwardly facing edge that may be spaced from a complimentarily shaped upwardly facing edge of the first portion.

In some embodiments, the pad support beam may include an elongated main beam portion that may be situated vertically above the first rail of the first section of the patient support frame when the patient support frame is oriented to support a patient in a prone position. In some such embodiments, the pad support beam may have a first offset beam portion that may be appended to a first end of the elongated main beam portion and a second offset beam portion that may be appended to a second end of the elongated main beam portion. The first offset beam portion may be mounted to the first coupling assembly and the second offset beam portion may be mounted to the second coupling assembly. In some embodiments, the first and second coupling assemblies each may include an H-bracket that each may have a central member, a first pair of legs that may extend away from the central member in a first direction, and a second pair of legs that may extend away from the central member in a second direction opposite to the first direction. The patient support frame may be attached to the first pair of legs of each H-bracket and the pad support beam may be attached to the second pair of legs of each H-bracket.

According to still a further aspect of the present disclosure, a patient support apparatus for spine surgery may include a first lift column and a second lift column that may be spaced apart from the first lift column in a longitudinal dimension of the patient support apparatus. A patient support frame may extend longitudinally between the first and second lift columns. The patient support frame may include a first section to support a torso of a patient. The first section may have spaced apart first and second rails that may extend parallel with the longitudinal dimension of the patient support apparatus. The first section may have a head end region that may be coupled to the first lift column by a first coupling assembly. The patient support frame may have a beam that may extend from the first section and that may couple to the second lift column by a second coupling assembly. The beam may be coupled to a foot end region of the first section about midway between opposite sides of the first section. The patient support apparatus may further include a first thigh support that may be coupled to a first side of the beam and a second thigh support that may be coupled to a second side of the beam opposite to the first side. The patient support apparatus may also have a first shin support that may be coupled to the first side of the beam and a second shin support that may be coupled to the second side of the beam.

In some embodiments, the first and second thigh supports and first and second shin supports each may be pivotable relative to the beam about respective axes that are each substantially perpendicular to a longitudinal dimension of the beam. Thus, the first and second thigh supports and first and second shin supports each may be pivotable relative to the beam about respective axes and each axis may be substantially parallel with each of the other axes. In some embodiments, a resilient knee sleeve may be mounted on the beam and may be positioned to protect a patient's knees from contacting the beam.

According yet a further aspect of the present disclosure, a patient support apparatus for spine surgery may include a first lift column and a second lift column that may be spaced apart from the first lift column in a longitudinal dimension of the patient support apparatus. A patient support frame may extend longitudinally between the first and second lift columns. The patient support frame may include a first section to support a torso of a patient. The first section may have spaced apart first and second rails that may extend parallel with the longitudinal dimension of the patient support apparatus. The first section may have a head end region that may be coupled to the first lift column by a first coupling assembly. The patient support frame may have a first beam that may extend from the first section and that may couple to the second lift column by a second coupling assembly. The patient support frame may include an arced member that may be coupled to a foot end region of the first beam. The patient support frame may have a second beam that may include a first end that may be pivotably coupled to the first section and a second end that may be supported by the arced member. The first and second beams may be coupled to a foot end region of the first section about midway between opposite sides of the first section.

The patient support apparatus may further have a first set of leg supports that may be located adjacent a first side of the second beam. The first set of leg supports may be movable relative to the second beam and relative to the first section of the patient support frame to support a first leg of the patient in a plurality of positions. The patient support apparatus may also have a second set of leg supports that may be located adjacent a second side of the second beam opposite to the first side. The second set of leg supports may be movable relative to the second beam and relative to the first section of the support frame to support a second leg of the patient in a plurality of positions.

In some embodiments, the second beam may be situated vertically above the first beam when the patient support frame is oriented to support a patient in a prone position. When the patient support frame is oriented to support the patient in the prone position, the first beam may include a first segment that may angle downwardly with respect to the foot end region of the first section, a second segment that may extend substantially horizontally from a lower end of the first segment, and a third segment that may angle upwardly from the second segment to the second coupling assembly.

In some embodiments, the first set of leg supports may include a thigh support that may be pivotably coupled to the second beam and an ankle support that may be slidably coupled to the second beam. In some embodiments, the thigh support may include an L-shaped pad that may have a bottom portion and an inner thigh engaging portion that may extend upwardly from the bottom portion when the patient support frame is oriented to support the patient in a prone position. Alternatively or additionally, the thigh support may include an outer thigh engaging portion that may be coupled to the bottom portion of the thigh support. The outer thigh engaging portion may be adjustable relative to the L-shaped pad to accommodate legs of different sizes.

The patient support apparatus may further include a tube that may be slidably coupled to the second beam for repositioning therealong. The tube may be lockable relative to the second beam. The thigh support may be pivotably coupled to the tube. In some embodiments, the ankle support may include a generally cylindrically shaped pad with a concave outer surface. In some embodiments, a tube may be slidably coupled to the second beam for repositioning therealong. The tube may be lockable relative to the second beam. The ankle support may extend laterally from the tube and may be supported relative to the tube in a cantilevered manner.

In some embodiments, the arced member may have a series of apertures therealong and the patient support apparatus may further include a locking pin to selectively lock the second beam in a plurality of positions relative to the arced member. In some embodiments, first and second handles may be coupled to respective first and second ends of the arced member. The first and second handles may be grippable to assist in turning the patient support frame relative to the first and second lift columns.

The patient support apparatus may further include a plurality of torso supports that may be coupled to the first section of the patient support frame and a pair of lateral supports that may extend upwardly from the first section of the of the patient support frame. The plurality of torso supports may bear more of the patient's weight than the pair of lateral supports when the patient support frame is oriented to support the patient in a prone position. The pair of lateral supports may bear more of the patient's weight than the plurality of torso supports when the patient support frame is oriented to support the patient in a lateral position. In some embodiments, the pair of lateral supports may include a chest engaging support that may engage a chest region of the patient and a hip engaging support that may engage a hip region of the patient.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which:

FIG. 10 is a side elevation view of the patient support frame of FIGS. 8 and 9;

FIG. 11A is a top plan view showing a hip support pivoted to a first orientation relative to an underlying lateral frame member of the first section of the patient support frame, the pivoting movement being constrained by interaction between a pair of posts that are received in arced slots formed at the opposite end regions of the hip support;

FIG. 11B is a top plan view, similar to FIG. 11A, showing the hip support pivoted to a second orientation relative to the underlying lateral frame member of the first section of the patient support frame;

DETAILED DESCRIPTION

Figures 1, 2:
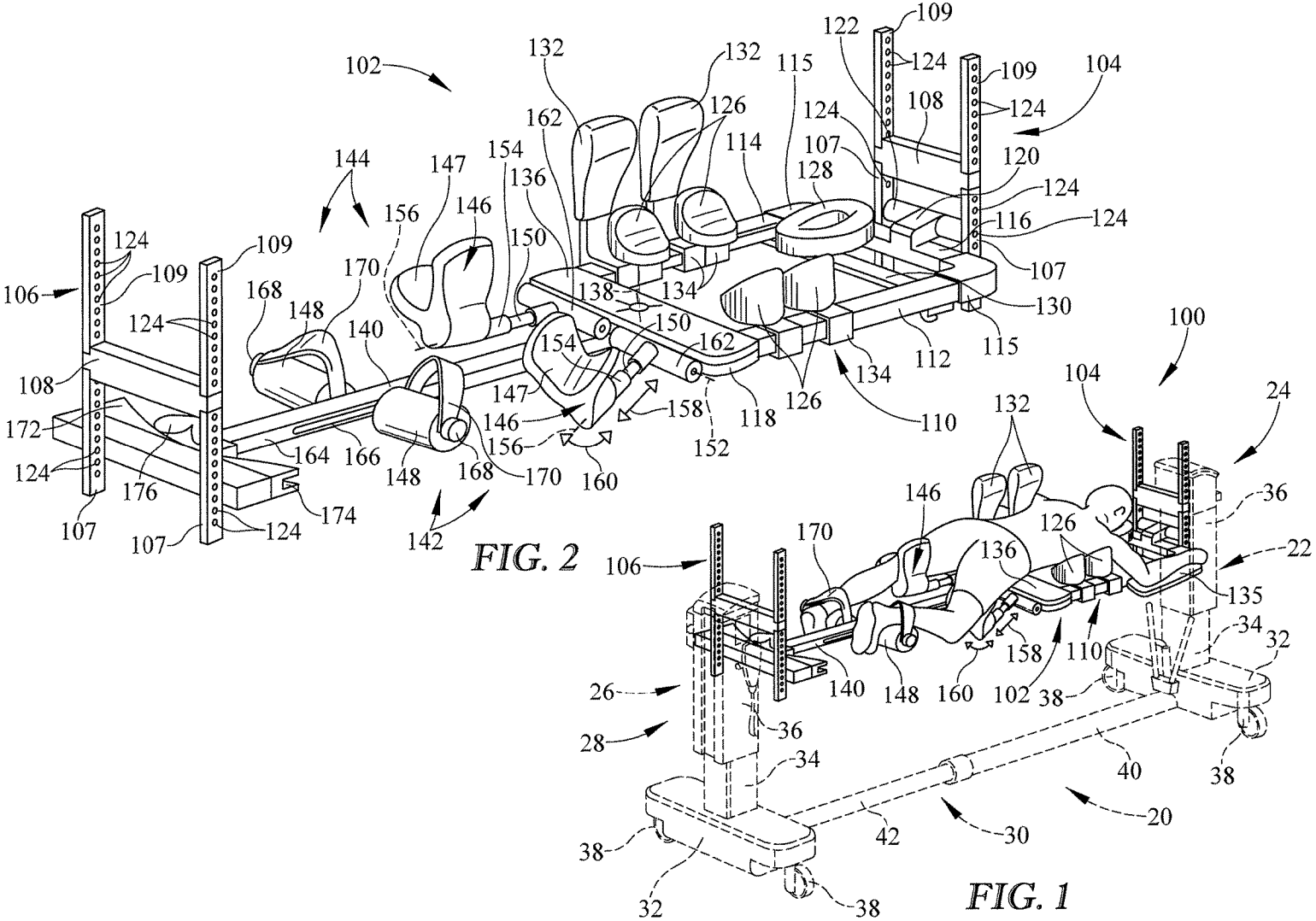
FIG. 1 is a perspective view of a first embodiment of a patient support apparatus for supporting a patient during spine surgery showing a base unit (in phantom) having first and second lift columns spaced apart longitudinally with an interconnecting spacer strut and showing a patient supported in a prone position on a patient support frame that has first and second ends coupled to the first and second lift columns by respective first and second coupling assemblies.
FIG. 2 is a perspective view of the patient support frame and coupling assemblies of FIG. 1 showing the coupling assemblies including head end and foot end H-brackets, the patient support frame having a generally rectangular first section with a plurality of torso support pads coupled thereto, the first section being coupled to the head end H-bracket, the patient support frame having a beam extending from a foot end region of the first section and coupling to the foot end H-bracket via an arced member, and first and second sets of leg supports on opposite sides of the beam.

The present disclosure includes various embodiments of a patient support apparatus that is used for spine surgery. Each embodiment includes a base unit 20 having a first lift column 22 situated at a head end 24 of the respective patient support apparatus, a second lift column 26 situated at a foot end 28 of the respective patient support apparatus, and an interconnecting strut 30 that extends between the first and second lift columns 22, 26 in substantially parallel relation with a longitudinal dimension of the respective patient support apparatus as shown in FIGS. 1, 3, 5, 8, 12, and 14-18 (in phantom in FIGS. 1, 3, 5, 8 and 12). As used in this description, the phrase "head end 24" will be used to denote the end of any referred-to object that is positioned to lie nearest the head end 24 of base unit 20 and the phrase "foot end 28" will be used to denote the end of any referred-to object that is positioned to lie nearest the foot end 28 of base unit 20. Each column 22, 26 includes a carriage 32, a substantially vertical first tubular segment 34 extending upwardly from the carriage 32, and a substantially vertical second tubular segment 36 that extends and retracts relative to the first tubular segment 34. Each of the carriages 32 extend generally parallel with a lateral dimension of the respective patient support apparatus and each carriage 32 is supported with respect to an underlying floor by a pair of casters 38.

Strut 30 assures that columns 22, 26 are spaced apart longitudinally by the proper amount for use during surgery when a respective patient support frame is attached. In the illustrative embodiments, strut 30 includes a first segment 40 and a second segment 42. In some embodiments, segments 40, 42 are coupled together for telescopic movement and in other embodiments, segments 40, 42 are coupled together for pivoting movement. In either case, segments 40, 42 are movable relative to each other, such as by telescoping or folding, to permit columns 22, 26 to move closer together for compact storage when the respective patient support apparatus is not in use and the respective patient support frame is detached from the columns 22, 26. In other embodiments, strut 30 is a single segment that does not telescope, fold, or otherwise move to permit the spacing between columns 22, 26 to be altered.

Other aspects of base unit 20 are shown and described in U.S. Patent Application Publication No. 2013/0269710 A1 which is hereby expressly incorporated by reference herein to the extent not inconsistent with the present disclosure which shall control as to any inconsistencies. In some embodiments, base unit 20 comprises a model number A-71100 Allen® Advance Table available from Allen Medical Systems, Inc. of Batesville, Ind. However, it is within the scope of this disclosure for the patient support frames disclosed herein to be configured for use with dual column surgical tables of other types including various versions of so-called Jackson tables, such as the Jackson 5803 table, and those available from Mizuho OSI, Inc., such as the proAXIS® Spinal Surgery Table and the Modular Table System (MTS) base, for example.

Referring now to FIGS. 1 and 2, a first embodiment of a patient support apparatus 100 for supporting a patient during spine surgery includes base unit 20 and a patient support frame 102 that has its head and foot ends 24, 28 coupled to the first and second lift columns 22, 26 by respective first and second coupling assemblies 104, 106. In the illustrative example, coupling assemblies 104, 106 each include H-brackets which, in turn, each include a central bar 108, a pair of lower legs 107 extending downwardly from opposite ends of bar 108 when patient support frame 102 is oriented to support the patient in a prone position, and a pair of upper legs 109 extending upwardly from opposite ends of bar 108 when patient support frame 102 is oriented to support the patient in the prone position. In some embodiments, legs 107, 109 are detachable from central bar 108 in the manner shown and described in U.S. Patent Application Publication No. 2013/0269710 A1 which is already incorporated by reference herein.

Patient support frame 102 includes a first section 110 which is generally rectangular in shape as shown best in FIG. 2. First section 110 is sized to support a patient's torso and includes first and second side rails 112, 114, a head end rail 116, and a foot end rail 118. Rails 112, 114 extend longitudinally between the opposite ends of respective rails 116, 118 and thus, are parallel with the longitudinal dimension of patient support apparatus 100. In the illustrative example, frame 102 has a pair of rounded corner couplers 115 that interconnect the head end 24 of rails 112, 114 to respective ends of rail 116. Rails 112, 114, 116, 118 are sometimes referred to herein as frame members 112, 114, 116, 118.

A bar 120 projects from a central region of frame member 116 toward the head end 24 of apparatus 100. A coupling tube 122 is appended to the head end 24 of bar 120 and extends laterally with respect to apparatus 100 between lower legs 107 of coupling assembly 104. A pin (not shown) extends through tube 122 such that opposite ends of the pin are received in apertures 124 of legs 107 to couple the head end 24 of first section 110 to coupling assembly 104 in a manner that is shown and described in U.S. Patent Application Publication No. 2013/0269710 A1, for example. Legs 107, 109 each have a series of apertures 124 therealong to provide a plurality of mounting locations for patient support frame 102 and other styles of table tops (not shown).

A set of torso supports 126 are coupled to rails 112, 114 and a head support 128 is coupled to a cross member 130 that extends between rails 112, 114 as shown in FIG. 2. Two of torso supports 126 are coupled to rail 112 and two are coupled to rail 114. A pair of lateral supports 132 are coupled to rail 114 adjacent to respective torso supports 126. Lateral supports 132 extend upwardly beyond the upper surfaces of torso supports 126 when patient support frame 102 is oriented in a manner to support a patient in a prone position a shown in FIG. 1. Torso supports 126 and lateral supports 132 each have rail clamps 134 that releasably attach the supports 126, 132 to rails 112, 114. Thus, supports 126, 132 are repositionable along rails 112, 114 and the lateral supports 132 can be detached from rail 114 and attached to rail 112, if desired. Examples of suitable rail clamps 134 are shown and described in U.S. Patent Application Publication No. 2013/0269710 A1 and in U.S. Pat. No. 7,520,007 which is hereby incorporated by reference herein to the extent not inconsistent with the present disclosure which shall control as to any inconsistencies.

Bars 108 of coupling assemblies 104, 106 are attached to pivot shafts (not shown) that extend substantially horizontally from the upper end regions of tubular segments 36 of lift columns 22, 26. The pivot shafts are rotatable to permit the coupling assemblies 104, 106 and patient support frame 102 to rotate relative to base unit 20. The axes of rotation of the pivot shafts extend substantially parallel with the longitudinal dimension of apparatus 100. In FIG. 1, a patient is shown supported on patient support frame 102 in a prone position with the lateral supports 132 extending upwardly along the left side of the patient's torso. When patient support frame 102 and coupling assemblies 104, 106 are rotated by about 90° in the counterclockwise direction as determined by looking at apparatus 100 from the foot end 28, the patient moves from the prone position to a lateral position and the lateral supports 132 become positioned beneath the patient. Thus, when frame 102 is oriented to support the patient in the prone position, the weight of the patient's torso bears primarily on torso supports 126 and when the frame 102 is oriented to support the patient in the lateral position, the weight of the patient's torso bears primarily on the lateral supports 126 although, some of the patient's weight bears on the torso supports 126 that are adjacent the lateral supports 132 in the illustrative example.

In FIG. 1, an arm board 135 is shown supporting the patient's right arm. However, it should be understood that a second arm board 135 is provided for supporting the patient's left arm but that second arm board 135 cannot be seen in FIG. 1. The arm boards 135 are omitted in FIG. 2. Arm boards 135 coupled to rails 112, 114 with rail clamps that are substantially the same as the rail clamps described above in connection with supports 126, 132.

A hip support 136 is mounted to frame member 118 for pivoting movement about an axis 138 that is located about midway between the opposite ends of support 136. Torso supports 126, head support 128, lateral supports 132, and hip support 136 are padded supports in some embodiments. The padding includes, for example, one or more layers of foam, gel, or air bladders. These one or more padding layers are encased within a cover of each of supports 126, 128, 132, 136 in some embodiments. Optionally, head support 128 does not have a cover but is an exposed layer of foam in some embodiments. Head support 128 comprises a foam ring that is somewhat oval in shape in the illustrative example. In some embodiments, one or more of supports 126, 128, 132, 136 include a generally rigid panel either inside the covering or beneath or beside the covering as the case may be and depending upon the orientation of frame 102 relative to base unit 20.

Patient support frame 102 includes a beam 140 that extends from rail 118 of first section 110 and that is coupled to and supported with respect to second coupling assembly 106 as shown in FIG. 2. Beam 140 is coupled to foot end 28 of first section 110 about midway between opposite sides of first section 110. In some embodiments, beam 140 is coupled to rail 118 for pivoting movement about axis 138. In some such embodiments, head end 24 of beam 140 is located beneath rail 118 and is mounted on a lower end of a pivot shaft that has hip support 136 coupled to an upper end of the pivot shaft. Thus, the pivot shaft extends through an aperture in rail 118. If desired, hip support 136 and beam 140 are both keyed to the pivot shaft to rotate together relative to first section 110 about axis 138. In other embodiments, beam 140 and hip support 136 rotate independently about axis 138.

Patient support apparatus 100 includes a first set of leg supports 142 located adjacent a first side of beam 140 and a second set of leg supports 144 located adjacent a second side of beam 140. First set and second set of leg supports 142, 144 are movable relative to beam 140 and relative to first section 110 of the patient support frame 102 to support first and second legs of the patient in a plurality of positions. The first set of leg supports 142 are movable independently of the second set of leg supports 144 so that the patient's right and left legs can be placed in different positions. Leg supports 142, 144 each include a thigh support 146 pivotably coupled to foot end 28 of rail 118 of first section 110 of patient support frame 102 and an ankle support 148 slidably coupled to beam 140.

In the illustrative embodiment, each thigh support 146 includes a curved thigh cradle 147 and each ankle support 148 is generally cylindrical. In some embodiments, one or more of cradles 147 of thigh supports 146 and ankles supports 148 are padded in the manner discussed above. In the illustrative example, each thigh support 146 includes a support rod 150 having its head end 24 coupled to the foot end 28 of first section 110 for pivoting movement about a first axis 152 that is oriented in substantially perpendicular relation with the longitudinal dimension of apparatus 100. Each thigh support 146 includes a second rod 154 that extends and retracts relative to the first rod 150 along a second axis 156 that is substantially perpendicular to the first axis 152 as indicated by double headed straight arrow 158 in FIGS. 1 and 2. The thigh support cradle 147 is coupled to the second rod and is rotatable about the second axis 156 as indicated by double headed curved arrow 160 in FIGS. 1 and 2. Rods 150 are attached to T-shaped couplers 162 that are mounted to rail 118 for pivoting movement about axis 152.

Each ankle support 148 extends laterally from beam 140 and is supported relative to beam 140 in a cantilevered manner. Opposite sidewalls 164 of beam 140 are formed to include slots 166. Ankle supports 148 have rods (not shown) that extend through slots 166 so that ends of the rods are situated in an interior region of beam 140. A knob 168 is provided at the end of each of the rods of ankle supports 148 and is rotated to tighten and loosen the rod (depending upon the direction of rotation of knob 168) relative to beam 140. Thus, in some embodiments, a receiving block or nut inside the interior region of beam 140 receives a threaded end of the rod that extends through each ankle support from the respective knob 168. When knob 168 is tightened the respective side wall 164 of beam becomes clamped between the block or nut and the end surface of the respective ankle support 148 that is adjacent the side wall 164. Each ankle support 148 includes a strap 170 to retain a patient's leg on the respective ankle support 148 as shown in FIG. 1. Similar straps are provided on thigh supports 146 in some embodiments. Additional straps are also used around the patient's torso and arms in some embodiments.

Second coupling assembly 106 includes an arced member 172 that supports foot end 28 of beam 140. The foot end 28 of beam 140 travels along the arced member as beam 140 pivots about axis 138. In the illustrative embodiment, arced member 172 includes an arced track 174 and foot end 28 of beam 140 is received within the arced track 174. It will be appreciated that the curvature of the arced track 174 is centered on pivot axis 138 in some embodiments. In alternative embodiments, beam 140 is pivotable relative to first section 110 of frame 102 about a second axis that is spaced from and parallel with axis 138. In such embodiments, the curvature of track 174 is centered on the second axis. A releasable clamp or other suitable lock 176 is provided to lock the beam 140 in place relative to arced member 172 once beam 140 is moved to a desired position.

In the illustrative example, arced member 172 is attached directly to a front surface of legs 107 of second coupling assembly 106 such as by welding, for example. In other embodiments, member 172 includes a bar and tube arrangement similar to bar 120 and tube 122 located at the head end of frame 102 for coupling to legs 107 of coupling assembly 106 with a pin that extends through the tube and through apertures 124 of the associated legs 107.

Figures 3, 4:
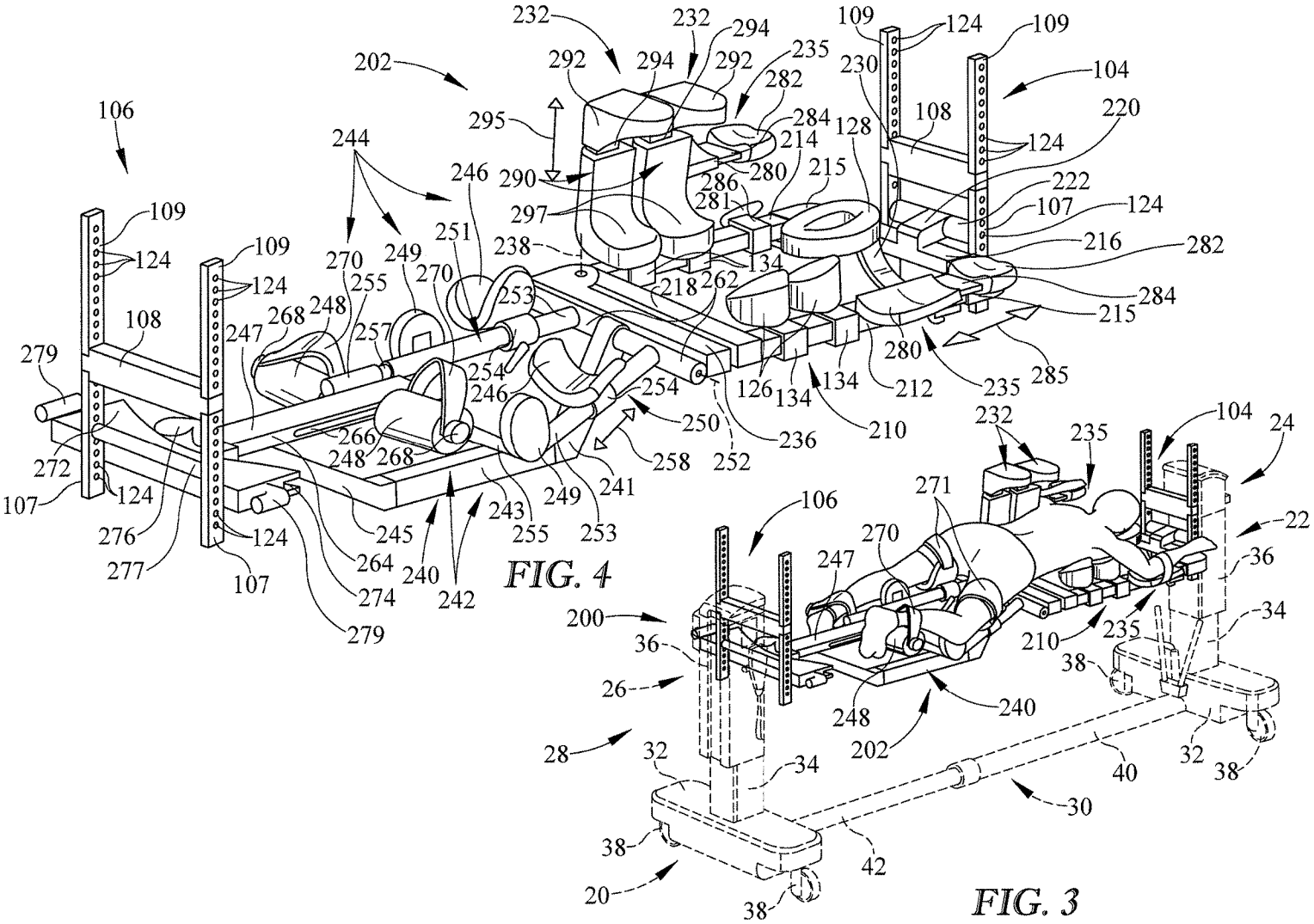
FIG. 3 is a perspective view, similar to FIG. 1, of a second embodiment of a patient support apparatus for supporting a patient during spine surgery showing a patient supported in a prone position atop a patient support frame of the second embodiment.
FIG. 4 is a perspective view of the patient support frame and coupling assemblies of FIG. 3 showing the coupling assemblies including head end and foot end H-brackets, the patient support frame having a generally rectangular first section with a plurality of torso support pads coupled thereto, the first section being coupled to the head end H-bracket, the patient support frame having a 3-segment lower beam extending from a foot end region of the first section toward the foot end H-bracket, a second beam extending in a cantilevered manner from an arced member that is coupled to the foot end H-bracket, first and second ankle supports coupled to the second beam, first and second rods extending between the foot end region of the first section and the ankle supports, and first and second thigh supports coupled to the first and second rods on opposite sides of the beam.

Referring now to FIGS. 3 and 4, a second embodiment of a patient support apparatus 200 for supporting a patient during spine surgery includes base unit 20 and a patient support frame 202 that has its head and foot ends 24, 28 coupled to the first and second lift columns 22, 26 by coupling assemblies 104, 106 that include H-brackets having respective bars 108, lower legs 107, and upper legs 109. Because coupling assemblies 104, 106 of frame 202 are substantially the same as coupling assemblies 104, 106 of frame 102, the same reference numbers are used and the discussion above is equally applicable to coupling assemblies 104, 106 of frame 202. Furthermore, in the description of apparatus 200 that follows, other components of apparatus 200 that are substantially the same as components of apparatus 100 are denoted with like reference numerals and the description of these various components above in connection with apparatus 100 is equally applicable to apparatus 200.

Patient support frame 202 includes a first section 210 which is generally rectangular in shape as shown best in FIG. 4. First section 210 is sized to support a patient's torso and includes first and second side rails 212, 214, a head end rail 216, and a foot end rail 218. Rails 212, 214 extend longitudinally between the opposite ends of respective rails 216, 218 and thus, are parallel with the longitudinal dimension of patient support apparatus 200. In the illustrative example, frame 202 has a pair of rounded corner couplers 215 that interconnect the head end 24 of rails 212, 214 to respective ends of rail 216. Rails 212, 214, 216, 218 are sometimes referred to herein as frame members 212, 214, 216, 218. A bar 220 projects from a central region of frame member 216 toward the head end 24 of apparatus 200. A coupling tube 222 is appended to the head end 24 of bar 220 and extends laterally with respect to apparatus 200 between lower legs 107 of coupling assembly 104. A pin (not shown) extends through tube 222 such that opposite ends of the pin are received in apertures 124 of legs 107 to couple the head end 24 of first section 210 to coupling assembly 104 in the same manner as described above in connection with apparatus 100.

In the illustrative embodiment, a pair of torso supports 126 is coupled to rail 212 with rail clamps 134. Of course, torso supports 126 are detachable from rail 212 and are coupleable to rail 214 as desired. A head support 128 is coupled to a pair of curved cross members 230 that extends from respective rails 212, 214 toward the central region of the first section 210 as shown in FIG. 4. Apparatus 200 includes first and second armboards 235 that are coupled to rails 212, 214, respectively. Each arm board 235 includes a forearm supporting portion 280 and a hand supporting portion 282 that is telescopically coupled to portion 280 by a bar 284. Thus, bar 284 extends and retracts relative to portion 280 to adjust the spacing between portions 280, 282, thereby to accommodate patient arms of different sizes, as indicated by double headed arrow 285 in FIG. 4. Each armboard 235 is coupled to a respective rail 212, 214 by an armboard clamp 286 and one or more rods or struts (not shown) extend between each clamp 286 and the respective armboard 235 as is well-known in the art.

A pair of lateral supports 232 are coupled to rail 214 via respective rail clamps 134 and are aligned laterally with the torso supports 126 on rail 212. Lateral supports 232 each include a first support portion 290 and a second support portion 292 that is telescopically coupled to portion 290 by a bar 294. Thus, bar 294 extends and retracts relative to portion 290 to adjust the spacing between portions 290, 292, thereby to accommodate patient torsos of different sizes, as indicated by double headed arrow 295 in FIG. 4. Lateral supports 232 extend upwardly beyond the upper surfaces of torso supports 126 when patient support frame 202 is oriented in a manner to support a patient in a prone position a shown in FIG. 3. Portions 290 of lateral supports 232 each have torso supporting surfaces 297 that underlie the patient's torso when the patient is supported in the prone position by frame 202. Thus, lateral supports 232 are configured to serve a torso supporting function as well. Hence, separate torso supports 126 are not needed on rail 214 in the illustrative example since lateral supports 232 serve this purpose. Lateral supports 232 are configured to cradle a side of the patient's torso when frame 202 is rotated relative to base 20 to support the patient in a lateral position.

First section 210 of frame 202 includes a second frame member or rail 236 that is mounted to frame member 218 for pivoting movement about an axis 238 which is located adjacent the foot end 28 of rail 214. Frame members 218, 236 cooperate to serve as a hip support 218, 236 of frame 202. Torso supports 126, head support 128, lateral supports 232, and hip support 218, 236 are padded supports in some embodiments. Thus, the discussion above regarding the types of suitable padding and optional covers in connection with apparatus 100 is equally applicable to supports 126, 128, 232, 218, 236 of apparatus 200.

Patient support frame 202 includes a first beam 240 that extends from rail 236 of first section 210 and that is coupled to and supported with respect to second coupling assembly 106 as shown in FIG. 4. Beam 240 is coupled to foot end 28 of first section 210 about midway between opposite sides of first section 210. In the illustrative embodiment, beam 240 is coupled to rail 236 with a rigid connection so that beam 240 and rail 236 pivot together about axis 238. Beam 240 is a three-segment beam in the illustrative embodiment. Thus, beam 240 includes first, second, and third segments 241, 243, 245. When frame 202 is oriented to support a patient in a prone position, first segment 241 angles downwardly with respect to the foot end 28 of first section 210, second segment 243 extends horizontally from a lower end of first segment 241, and third segment 245 angles upwardly from the second segment 243 to the second coupling assembly 106.

Frame 202 includes a second beam 247 having its foot end 28 coupled to coupling assembly 106 and terminating at its head end 24 in spaced apart relation with first section 210. In the illustrative example, beam 247 is situated substantially vertically above beam 240 and head end of 24 of beam 247 is located above second segment 243 of beam 240. The upper end of third segment 245 of beam 240 is rigidly attached to an undersurface of beam 247, such as by welding, for example. Thus, beam 247 extends from coupling assembly 106 in a cantilevered manner.

Patient support apparatus 200 includes a first leg support strut 250 coupled to the foot end 28 of rail 236 of first section 210 adjacent a first side of beam 240 and a second leg support strut 251 coupled to foot end 28 of rail 236 of first section 210 adjacent a second side of beam 210 opposite to the first side. A first set of leg support pads 242 are coupled to first leg support strut 250 and a second set of leg support pads 244 are coupled to the second leg support strut 251. The first and second sets of leg support pads 242, 244 each include a thigh pad 246, an ankle pad 248, and a knee pad 249. Pads 246, 248 underlie the patient's thighs and ankles, respectively, and knee pads 249 are situated along the insides of the patient's knees to prevent them from buckling inwardly toward each other when frame 202 is oriented to support the patient in the prone position.

Struts 250, 251 and first and second sets of leg supports 242, 244 are movable relative to beam 240 and relative to first section 210 of the patient support frame 202 to support first and second legs of the patient in a plurality of positions. The first set of leg supports 242 are movable independently of the second set of leg supports 244 so that the patient's right and left legs can be placed in different positions. In the illustrative example, struts 250, 251 are cylindrical bars or tubes and thigh support pads 246 couple to struts 250, 251 with respective lockable collars 254. Thus, thigh support pads 246 are movable along the length of struts 250, 251 between the head end 24 of struts 250, 251 and the respective knee pads 249 as indicated by double headed arrow 258 in FIG. 4 when the respective locking collar 254 is unlocked. Each thigh support pad 246 is also rotatable about the respective strut 250, 251 when the associated locking collar 254 is unlocked.

In the illustrative embodiment, each thigh support pad 246 is shaped as a curved thigh cradle and each ankle support 248 is generally cylindrical. In the illustrative example, each strut 250, 251 has a head end portion 253 coupled to the foot end 28 of first section 110 for pivoting movement about a first axis 252 that is oriented in substantially perpendicular relation with the longitudinal dimension of apparatus 200. Also in the illustrative example, each strut 250, 251 includes a foot end portion 255 that extends and retracts relative to the head end portion 253. The thigh support pads 246 and knee pads 249 are coupled to the head end portions 253 of respective struts 250, 251. Portions 253 are attached to tubular couplers 262 that are mounted to rail 236 for pivoting movement about axis 252.

Each ankle support 248 extends laterally from beam 247 and is supported relative to beam 247 in a cantilevered manner. Opposite sidewalls 264 of beam 247 are formed to include slots 266. Ankle supports 248 have rods (not shown) that extend through slots 266 so that ends of the rods are situated in an interior region of beam 247. A knob 268 is provided at the end of each of the rods of ankle supports 248 and is rotated to tighten and loosen the rod (depending upon the direction of rotation of knob 268) relative to beam 247. Thus, ankle pads 248 are locked and released for repositioning along beam 247 in the same manner as described in connection with ankle supports 148 relative to beam 140. Each ankle pad 248 includes a strap 270 to retain a patient's leg on the respective ankle pad 248 as shown in FIG. 3. Similar straps 271 are provided on thigh pads 246 as also shown in FIG. 3. Additional straps are also used around the patient's torso and arms in some embodiments.

Portions 255 of struts 250, 251 are coupled to respective ankle pads 248. Thus, as ankle pads 248 are repositioned relative to beam 247, the associated portions 255 either telescope or articulate or both relative to the respective portions 253 of struts 250, 251. Thus, a joint 257 that is flexible and that telescopes relative to portion 253 is provided at the interface between portions 253, 255 of respective struts 250, 251.

Second coupling assembly 106 of apparatus 200 includes an arced member 272 that supports foot end 28 of beam 247. The foot end 28 of beam 247 travels along the arced member 272 as beams 240, 247 pivot about axis 238. Rail 236 is configured so that when oriented in parallel relation with rail 218, a gap exists therebetween so that rail 236 is able to pivot from the parallel orientation toward rail 218 to close the gap. Of course, rail 236 is able to pivot in the opposite direction relative to rail 218 to widen the gap. In the illustrative embodiment, arced member 272 includes an arced track 274 and foot end 28 of beam 247 is received within the arced track 274. It will be appreciated that the curvature of the arced track 274 is centered on pivot axis 238. A releasable clamp or other suitable lock 276 is provided to lock the beam 247 in place relative to arced member 272 once beam 247 is moved to a desired position. Because beam 240 is rigidly attached to beam 247, movement of beam 247 along track 274 about axis 238 also moves beam 240 and rail 236 about axis 238. Furthermore, the struts 250, 251 and accompanying sets of leg supports 242, 244 also move about axis 238 because these are attached to rail 236.

In the illustrative example, arced member 272 has a coupling tube 277 that is situated between legs 107 of second coupling assembly 106 and a pin (not shown) extends through coupling tube 277 and through apertures 124 of the associated legs 107 to couple arced member 272 to legs 107. Also, in the illustrative FIG. 4 example, a handle 279 is provided at each end of arced member 272. Handles 279 are grippable by a user to assist in rotating frame 202 relative to base unit 20 thereby to move the patient from the prone position to the lateral position. Similar handles 281 are coupled to first section 210 of frame 202 to assist with rotation of frame 202 relative to base unit 20.

Figures 5, 6, 7:
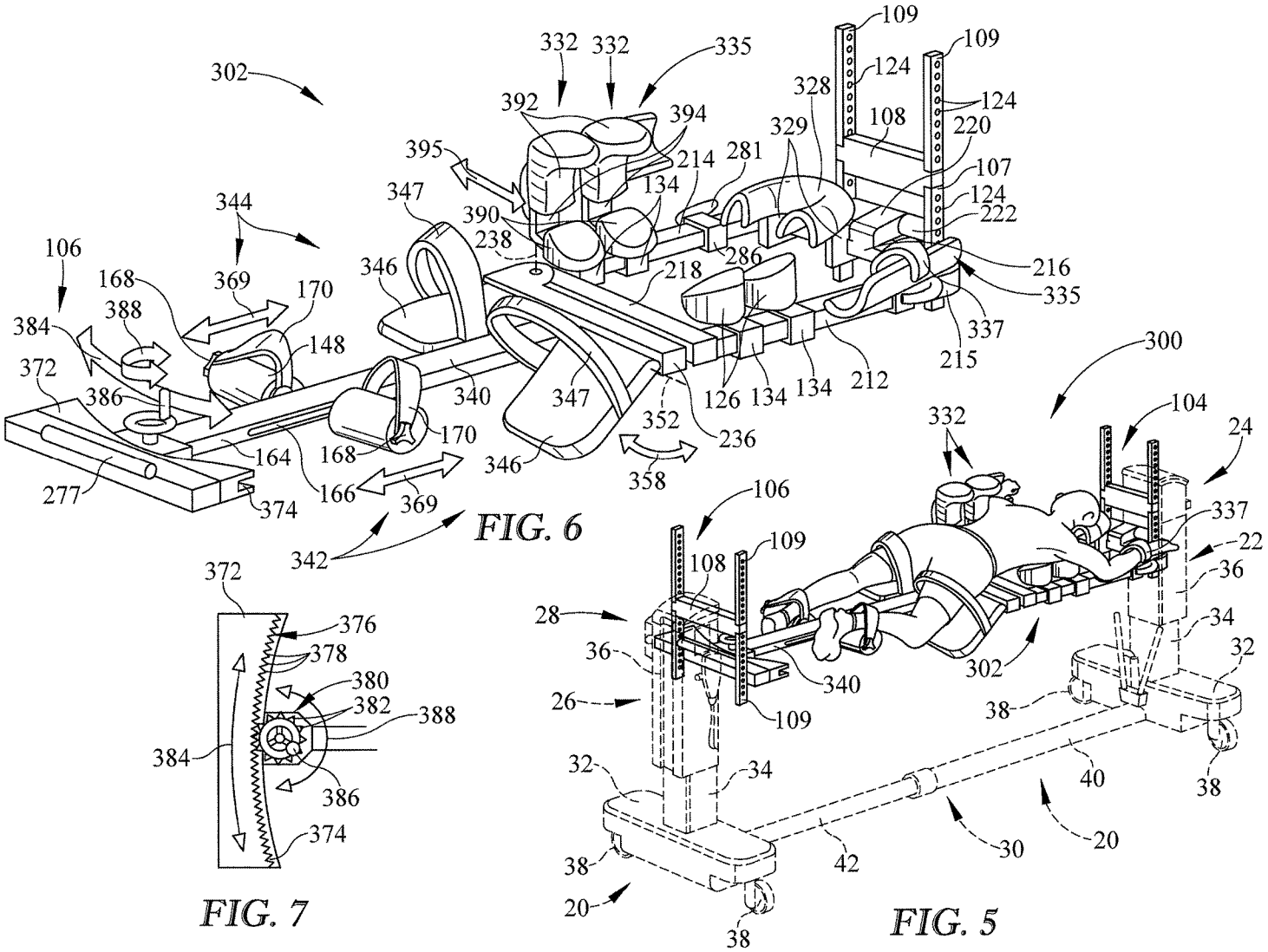
FIG. 5 is a perspective view, similar to FIGS. 1 and 3, of a third embodiment of a patient support apparatus for supporting a patient during spine surgery showing a patient supported in a prone position atop a patient support frame of the third embodiment.
FIG. 6 is a perspective view of the patient support frame and coupling assemblies of FIG. 5 showing the coupling assemblies including head end and foot end H-brackets, the patient support frame having a generally rectangular first section with a plurality of torso support pads coupled thereto, the first section being coupled to the head end H-bracket, the patient support frame having a beam extending from a foot end region of the first section and coupling to the foot end H-bracket via an arced member, and first and second sets of leg supports on opposite sides of the beam.
FIG. 7 is a sectional view taken horizontally through the arced member of FIGS. 5 and 6 showing the arced member having an arced rack with a first set of teeth, a pinion coupled to the foot end of the beam and having a second set of teeth that interface with the first set of teeth, and a handle coupled to the pinion so that the pinion is manually rotatable to move the foot end of the beam along the arced member.

Referring now to FIGS. 5-7, a third embodiment of a patient support apparatus 300 for supporting a patient during spine surgery includes base unit 20 and a patient support frame 302 that has its head and foot ends 24, 28 coupled to the first and second lift columns 22, 26 by coupling assemblies 104, 106 that include H-brackets having respective bars 108, lower legs 107, and upper legs 109. Thus, coupling assemblies 104, 106 of frame 302 are substantially the same as coupling assemblies 104, 106 of the previously described embodiments. Similarly, in the description of apparatus 300 that follows, other components of apparatus 300 that are substantially the same as components of apparatus 100 or apparatus 200 are denoted with like reference numerals and the description of these various components above in connection with apparatuses 100, 200 is equally applicable to apparatus 300.

Patient support frame 302 includes a first section 310 which is generally rectangular in shape as shown best in FIG. 6. First section 310 of apparatus 300 is substantially similar to first section 210 of apparatus 200. Thus, the 200-series reference numbers are used for first section 310 and the description of the various 200-series components is not repeated. Furthermore, torso supports 126 and associated clamps 134 are mounted on rail 212 of first section 310 of apparatus and so the 100-series reference numbers are used for these and the description is not repeated.

Head support 328 has an overall U-shape (i.e., when viewed from above, for example) and its cross section is also U-shaped. A pair of support flanges 329 couple head support 328 to frame member 216 for lateral movement along frame members 216. Thus, head support 328 is movable and lockable by suitable locks (not shown) in a plurality of positions between rails 212, 214. Apparatus 300 includes first and second armboards 335 that are coupled to rails 212, 214, respectively. Each armboard 335 is shaped as a curved arm cradle. Straps 337 are provided to secure the patient's arms to the respective armboards 335.

A pair of lateral supports 332 are coupled to rail 214 via respective rail clamps 134 and are aligned laterally with the torso supports 126 on rail 212. Lateral supports 332 each include a first support portion 390 and a second support portion 392 that is coupled to portion 390 by an L-shaped bar 394. Thus, the L-shape of bar 394 permits portions 392 to extend and retract relative to portion 390 in two dimensions, one of which corresponds to double headed arrow 295 (see FIG. 4) and the other of which corresponds to double headed arrow 395 in FIG. 6, to adjust the spacing between portions 390, 392, thereby to accommodate patient torsos of different sizes. In some embodiments, suitable locks are provided to lock and release movement of portions 392 and bars 394 relative to respective portions 390 and to lock and release movement of portions 392 relative to respective bars 394.

Lateral supports 332 extend upwardly beyond the upper surfaces of torso supports 126 when patient support frame 302 is oriented in a manner to support a patient in a prone position as shown in FIG. 5. Portions 390 of lateral supports 232 each have torso supporting surfaces that underlie the patient's torso when the patient is supported in the prone position by frame 302. Thus, lateral supports 332 are configured to serve a torso supporting function as well. Hence, separate torso supports 126 are not needed on rail 214 in the illustrative example since lateral supports 332 serve this purpose. Lateral supports 332 are configured to cradle a side of the patient's torso when frame 302 is rotated relative to base 20 to support the patient in a lateral position.

Patient support frame 302 includes a beam 340 that extends from rail 236 of first section 310 and that is coupled to and supported with respect to second coupling assembly 106 as shown in FIG. 6. Beam 340 is coupled to foot end 28 of first section 310 about midway between opposite sides of first section 310. In the illustrative embodiment, beam 340 is coupled to rail 236 with a rigid connection so that beam 340 and rail 236 pivot together about axis 238.

A first set of leg supports 342 is located on a first side of beam 340 and a second set of leg supports 344 is located on a second side of beam 340 opposite of the first side. The first and second leg supports 342, 344 each include a thigh support 346 having its head end 24 coupled to rail 236 for pivoting movement about an axis 352 as indicated by double headed curved arrow 358. Axis 352 is perpendicular to the longitudinal dimension of apparatus 300 when rail 236 is oriented parallel with rail 218. First and second leg supports 343, 344 also include ankle supports 148, knobs 168, and straps 170 that are substantially the same as these same components of apparatus 100. Thus, the descriptions of these components is not repeated. FIG. 6 does, however, have a pair of double headed arrows 369 to indicate the adjustability of ankle supports 148 along beam 340.

First and second sets of leg supports 342, 344 are movable relative to beam 340 and relative to first section 310 of the patient support frame 302 to support first and second legs of the patient in a plurality of positions. The first set of leg supports 342 are movable independently of the second set of leg supports 344 so that the patient's right and left legs can be placed in different positions. In the illustrative embodiment, each thigh support 346 is shaped as a flat panel. A strap 347 is provided with each thigh support 346 to secure a patient's thigh to the respective thigh support 346.

Second coupling assembly 106 of apparatus 300 includes an arced member 372 that supports foot end 28 of beam 340. The foot end 28 of beam 340 travels along the arced member 372 as beam 340 and rail 236 pivot about axis 238. In the illustrative embodiment, arced member 372 includes an arced track 374 and an arced rack 376 having a first set of gear teeth 378. A pinion 380 is mounted to the foot end region of beam 340 and a portion of pinion 380 is received within the arced track 274. Pinion 380 has a second set of teeth 382 that interface with the first set of teeth 380 of curved rack 376. The pinion 380 is rotatable to move the foot end 28 of beam 340 along the arced member 372 as indicated by doubled headed curved arrow 384 in FIGS. 6 and 7. A handle 386 is coupled to the pinion 380 and is manually movable to rotate pinion 380, as indicated by double headed curved arrow 388 in FIGS. 6 and 7, thereby to move the foot end 28 of beam 340 along the arced member 372. It will be appreciated that the curvature of the arced track 374 and arced rack 376 is centered on pivot axis 238 in apparatus 300. Alternative embodiments, such as in apparatus 100, included curved rack 376 and an associated pinion 380 and handle 386 with the center of curvature of the curved rack 376 in such an embodiment being centered on axis 138.

Figures 8, 9:
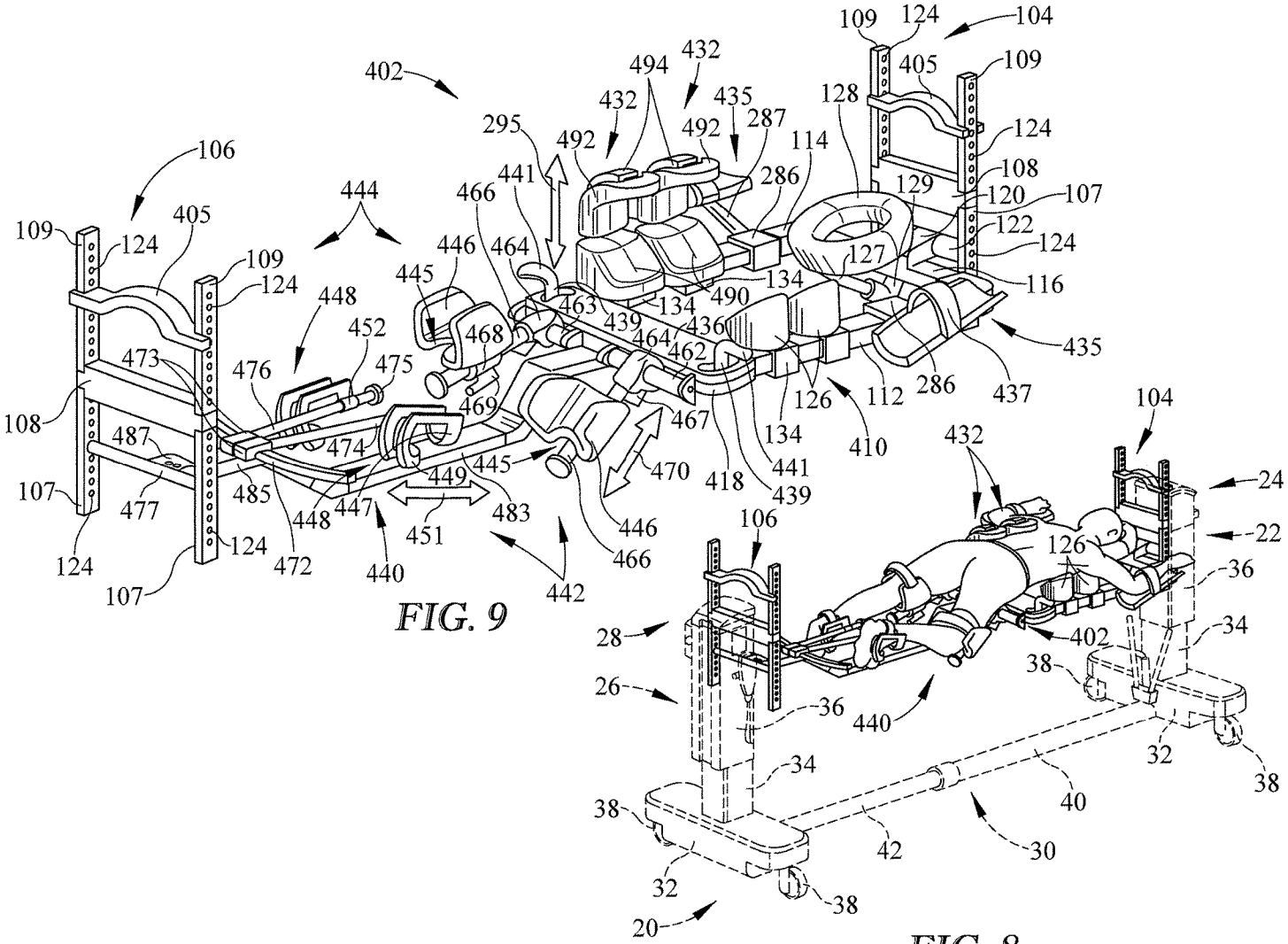
FIG. 8 is a perspective view, similar to FIGS. 1, 3 and 5, of a fourth embodiment of a patient support apparatus for supporting a patient during spine surgery showing a patient supported in a prone position atop a patient support frame of the fourth embodiment.
FIG. 9 is a perspective view of the patient support frame and coupling assemblies of FIG. 8 showing the coupling assemblies including head end and foot end H-brackets, grip handles coupled to upper legs of each of the H-brackets, the grip handles being grippable to manually rotate the patient support frame relative to the first and second lift columns, the patient support frame having a generally rectangular first section with a plurality of torso support pads coupled thereto, the first section being coupled to lower legs of the head end H-bracket, the patient support frame having a multi-segment beam extending from a foot end region of the first section and coupling to lower legs of the foot end H-bracket, an arced member that is coupled to the foot end region of the beam, first and second rods extending from the arced member toward the first section, first and second ankle supports coupled to the first and second rods, respectively, and first and second thigh supports coupled to the foot end of the first section.

Referring now to FIGS. 8-10, a fourth embodiment of a patient support apparatus 400 for supporting a patient during spine surgery includes base unit 20 and a patient support frame 402 that has its head and foot ends 24, 28 coupled to the first and second lift columns 22, 26 by coupling assemblies 104, 106 that include H-brackets having respective bars 108, lower legs 107, and upper legs 109. Thus, coupling assemblies 104, 106 of frame 402 are substantially the same as coupling assemblies 104, 106 of the previously described embodiments. Similarly, in the description of apparatus 400 that follows, other components of apparatus 400 that are substantially the same as components of any of apparatuses 100, 200, 300 are denoted with like reference numerals and the description of these various components above in connection with apparatuses 100, 200, 300 is equally applicable to apparatus 400.

Apparatus 400 has a grip handle 405 coupled to each pair of legs 109 of coupling assemblies 104, 106. Grip handles 405 are gripped by a user to assist in rotating patient support frame 402 relative to base unit 20. Patient support frame 402 includes a first section 410 which is generally rectangular in shape as shown best in FIG. 9. First section 410 of apparatus 400 is substantially similar to first section 110 of apparatus 100. Thus, the 100-series reference numbers are used for first section 410 and the description of the various 100-series components is not repeated. Furthermore, torso supports 126 and associated clamps 134 are mounted on rail 112 of first section 410 of apparatus 400 and so the 100-series reference numbers are used for these and the description is not repeated.

Head support 128 is coupled to frame member 116 by a rod 127 and a V-shaped tubular member 129 as shown in FIG. 9. Rod 127 angles downwardly from foot end 28 of head support 128 and toward head end 24 of apparatus 400. A first segment of V-shaped tubular 129 member receives an end of rod 127 and a second segment of V-shaped tubular member 129 is appended to the undersurface of frame member 116. Apparatus 400 includes first and second armboards 435 that are coupled to rails 112, 114, respectively, by respective armboard clamps 286. A rod or strut 287 extends from each clamp 286 to the respective armboard 435. Each armboard 435 is shaped as a curved arm cradle. Straps 437 are provided to secure the patient's arms to the respective armboards 435.

A pair of lateral supports 432 are coupled to rail 114 via respective rail clamps 134 and are aligned laterally with the torso supports 126 on rail 112. Lateral supports 432 each include a first support portion 490 and a second support portion 492 that is coupled to portion 490 by an upside down L-shaped bar 494 that extends around the top and back of portion 492 and has a lower end that is received in an upper end of a tubular member 495 (see FIG. 10) situated at the back of portion 490. Thus, the receipt of bar 494 in member 495 permits adjustment of the spacing between portions 490, 492 as indicated by double headed arrow 295, thereby to accommodate patient torsos of different sizes. In some embodiments, suitable locks are provided to lock and release movement bar 494 and the corresponding portion 492 relative to tubular member 495 and the corresponding portions 490.

Lateral supports 432 extend upwardly beyond the upper surfaces of torso supports 126 when patient support frame 402 is oriented in a manner to support a patient in a prone position as shown in FIG. 8. Portions 490 of lateral supports 432 each have torso supporting surfaces that underlie the patient's torso when the patient is supported in the prone position by frame 402. Thus, lateral supports 432 are configured to serve a torso supporting function as well. Hence, separate torso supports 126 are not needed on rail 114 in the illustrative example since lateral supports 432 serve this purpose. Lateral supports 432 are configured to cradle a side of the patient's torso when frame 402 is rotated relative to base unit 20 to support the patient in the lateral position.

First section 410 of frame 402 includes a frame member or rail 418 extending laterally between the foot ends 28 of rails 112, 114 as shown in FIG. 9. Frame 402 includes a hip support 436 situated atop frame member 418. In some embodiments, hip support 436 is padded as discussed above in connection with hip support 118. Hip support 436 has arced slots 437 at its opposite ends and frame member 418 has arced slots 419 at its opposite ends as shown in FIGS. 11A and 11B. Pins 439 extend through slots 419, 437 and interaction between pins 439 and slots 419, 437 guide the manner in which hip support 436 is pivotable relative to the underlying frame member 418.

The radii of curvature of each slot 419, 437 is smaller than the distance defined between the two pins 439. Thus, pins 439 are movable within the slots 419, 437. This is apparent by comparing FIG. 11A, in which the pin 439 at the top set of slots 419, 437 is generally centered between the ends of the respective slots 419, 437, with FIG. 11B, in which the pin 439 at the top set of slots 419, 437 is adjacent one of the ends of the respective slots 419, 437 and, in particular in FIG. 11B, pin 439 at the top of the drawing is adjacent the left end of slot 419 and is adjacent the right end of slot 437. The opposite positioning of pin 439 at the bottom set of slots 419, 437 can also be seen in FIGS. 11A and 11B. That is, by comparing FIG. 11B, in which the pin 439 at the bottom set of slots 419, 437 is generally centered between the ends of the respective slots 419, 437, with FIG. 11A, in which the pin 439 at the bottom set of slots 419, 437 is adjacent one of the ends of the respective slots 419, 437 and, in particular in FIG. 11A, pin 439 at the bottom of the drawing is adjacent the left end of slot 419 and is adjacent the right end of slot 437. This type of pivotable coupling between hip support 436 and frame member 418 is referred to as a squirkle pivot according to this disclosure. Pins 439 have bent upper regions to provide handles 441 (see FIG. 9) that are used to manipulate the position of pins 439 within slots 419, 437 by a user.

Patient support frame 402 includes a beam 440 that extends from rail 418 of first section 410 and that is coupled to and supported with respect to second coupling assembly 106 as shown in FIG. 9. Beam 440 is coupled to foot end 28 of first section 410 about midway between opposite sides of first section 410. In the illustrative embodiment, beam 340 is coupled to rail 418 with a rigid connection so that beam 440 does not pivot with respect to first section 410. Beam 440 is a multi-segment beam that includes $1^{st}$ through $7^{th}$ segments 481, 482, 483, 484, 485, 486, 487 as shown best in FIG. 10.

When frame 402 is oriented to support the patient in the prone position, segment 481 extends horizontally from first section 410, second segment 482 angles downwardly from the foot end 28 of first segment 481 toward foot end 28 of apparatus 400, third segment 483 extends horizontally from the lower end of segment 482 toward foot end 28 of apparatus 400, fourth segment 484 angles upwardly from the foot end 28 of segment 483, fifth segment 485 extends horizontally from foot end 28 of segment 484 toward foot end 28 of apparatus 400, sixth segment 486 is shaped as a small step to interconnect segments 485, 487 and segment 487 extends horizontally from foot end 28 of segment 486 toward the foot end 28 of apparatus 40.

A coupling tube 477 is appended to the foot end 28 of segment 487 of beam 440 as shown in FIGS. 9 and 10. Tube 477 extends laterally with respect to apparatus 400 between lower legs 107 of coupling assembly 106 and a pin (not shown) extends through tube 477 and respective apertures 124 of legs 107 that are aligned with tube 477 to couple beam 440 to coupling assembly 106.

A first set of leg supports 442 is located on a first side of beam 440 and a second set of leg supports 444 is located on a second side of beam 440 opposite of the first side. The first and second leg supports 442, 444 each include a thigh support 446 and an ankle support 448. An arced rail 472 is supported on segment 472 of beam 440. The central region of arced rail 472 is affixed to beam 440 so that portions of rail 472 are positioned on opposite sides of beam 440. Apparatus 400 has first and second rods 474, 476 that are coupled to arced rail 472 by rail clamps 473. Ankle supports 448 are coupled to the respective first and second rods 474, 476. Clamps 473 are lockable and releasable, such as by turning a knobs 475 that are located at distal ends of rods 474, 476. When clamps 473 are released, the clamps 473 and respective rods 474, 476 and ankle supports 448 are movable along arced rail 472. In some embodiments, rods 474, 476 have one or more degrees of freedom of movement with respect to clamps 473, such as being able to be pivotably raised and lowered with respect to the associated clamp 473 when released.

In some embodiments, each of the ankle supports 448 include a first portion 447 that is configured to engage a patient's shin and a second portion 449 that is configured to engage a top of the patient's foot. The first and second portions 447, 449 of each of the ankle supports 448 each have a concave patient-engaging surface in the illustrative embodiment. Each ankle support 448 is repositionable along the respective first and second rod 474, 476 as indicated by double headed arrow 451 in FIG. 9. Ankle supports 448 each have a collar 452 that mounts the ankle support on the respective rod 474, 476. In some embodiments, a suitable lock, such as a threaded bolt and knob, is provided to lock and release collar 452 with respect to the corresponding rod 474, 476 thereby to lock and release the associated ankle support 448 with respect to the corresponding rod 474, 476.

In the illustrative embodiment, thigh supports 446 are configured as U-shaped leg cradles having respective U-shaped thigh support surfaces. Also in the illustrative example, thigh supports 446 each may have a notch 445 configured to receive a patient's knee cap. Patient support frame 402 has a first cylindrical bar 462 mounted to foot end 28 of first section 410 adjacent a first side of the beam 440 and a second cylindrical bar 463 mounted to foot end 28 of first section 410 adjacent a second side of beam 440. Clamps 464 are coupled to bars 462, 463 and rods 466 extend from each clamp 464. Thigh supports 446 are mounted on respective rods 466. Clamps 464 lock and release rods 466 and thigh supports 446 with respect to the corresponding bars 462, 463. Clamps 464 each have a release trigger 467 that is squeezed or otherwise moved to release the respective clamp 464 from clamping onto the corresponding bar 462, 463 so that the associated rod 466 and thigh support 446 are rotatable about the corresponding bar 462, 463.

In the illustrative embodiment, thigh supports 446 are mounted to respective rods 466 with collars 468. Release handles 469 are coupled to each collar 468 as shown in FIG. 9 with respect to one of the collars 468. Handles 469 are movable to lock and release the respective collar 468, and therefore, the associated thigh support 446 with respect to the corresponding rod 466. When handles 469 release collars 468, the thigh support 446 is movable along rod 466 as indicated by double headed arrow 470 shown in FIG. 9.

Figures 12, 13:
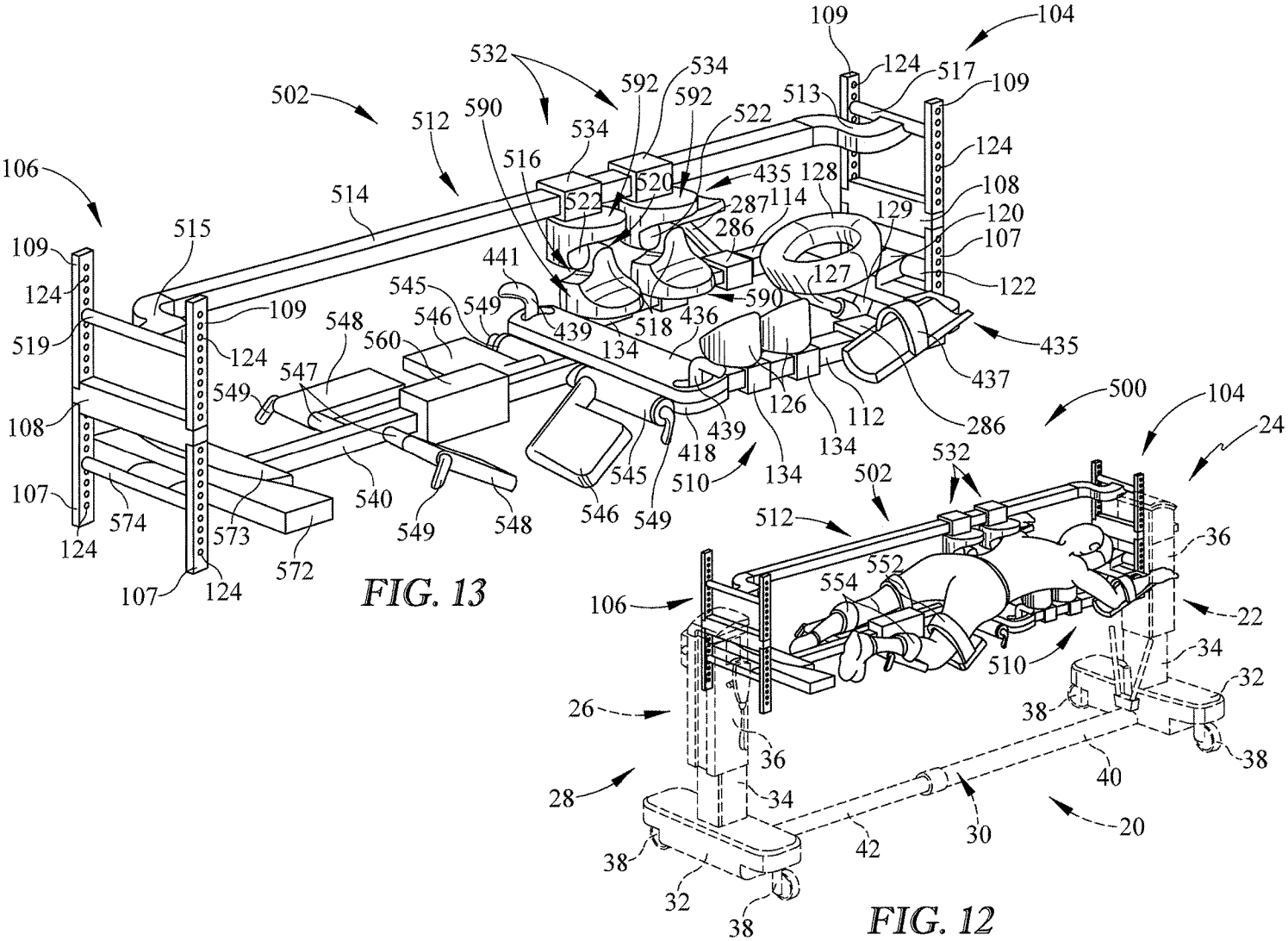
FIG. 12 is a perspective view, similar to FIGS. 1, 3, 5 and 8, of a fifth embodiment of a patient support apparatus for supporting a patient during spine surgery showing a patient supported in a prone position atop a patient support frame of the fifth embodiment.
FIG. 13 is a perspective view of the patient support frame and coupling assemblies of FIG. 12 showing the coupling assemblies including head end and foot end H-brackets, the patient support frame having a generally rectangular first section, the first section being coupled to lower legs of the head end H-bracket, the patient support frame having a beam extending from a foot end region of the first section and coupling to the foot end H-bracket via an arced member, first and second thigh supports and first and second shin supports on opposite sides of the beam, a pad support beam extending between upper legs of the H-brackets, and a set of lateral pads, each lateral pad including a first portion coupled to the first section of the patient support frame and extending toward the pad support beam, each lateral pad including a second portion coupled to the pad support beam and extending toward the patient support frame.

Referring now to FIGS. 12 and 13, a fifth embodiment of a patient support apparatus 500 for supporting a patient during spine surgery includes base unit 20 and a patient support frame 502 that has its head and foot ends 24, 28 coupled to the first and second lift columns 22, 26 by coupling assemblies 104, 106 that each include H-brackets having respective bars 108, lower legs 107, and upper legs 109. Thus, coupling assemblies 104, 106 of frame 502 are substantially the same as coupling assemblies 104, 106 of the previously described embodiments. Similarly, in the description of apparatus 500 that follows, other components of apparatus 500 that are substantially the same as components of any of apparatuses 100, 200, 300, 400 are denoted with like reference numerals and the description of these various components above in connection with apparatuses 100, 200, 300, 400 is equally applicable to apparatus 500. For example, patient support frame 502 includes a first section 510, torso supports 126, head support 128, armboards 435, and hip support 436 that are substantially the same as those of first section 410 of frame 402. Thus, the same reference numbers used for these components and related components of frame 402 are used for frame 502 and the description above these components is equally applicable.

Apparatus 500 includes a pad support beam 512 extending between the first and second coupling assemblies 104, 106 in spaced apart relation with the patient support frame 502 as shown in FIGS. 12 and 13. Pad support beam 512 includes an elongated main beam portion 514 that is situated vertically above rail 114 of first section 510 of patient support frame 502 when frame 502 is oriented to support a patient in a prone position. Pad support beam has a first offset beam portion 513 appended to head end 24 of the elongated main beam portion 514 and a second offset beam portion 515 appended to foot end 28 of the elongated main beam portion 514. First offset beam portion 513 is mounted to first coupling assembly 104 by a coupling tube 517 that is situated between legs 109 of assembly 104. Similarly, second offset beam portion 515 is mounted to second coupling assembly 106 by a coupling tube 519 that is situated between legs 109 of assembly 106. Pins extend through respective tubes 517, 519 and through apertures 124 of respective legs. Head end 24 of offset beam portion 513 is affixed to tube 517 and foot end 28 of offset beam portion 515 is affixed to tube 519.

Apparatus 500 includes a set of lateral pads 532. Each lateral pad 532 includes a first portion 590 coupled to rail 114 of first section 510 of frame 502 by a respective rail clamp 134. Each lateral pad 532 also includes a second portion 592 coupled to portion 514 of pad support beam 512 by a respective beam clamp 534. First portion 590 of each lateral pad 532 extends upwardly toward pad support beam 512 and second portion 592 of each lateral pads 532 extends downwardly toward first portion 510 of patient support frame 502 when frame 502 is oriented to support a patient in the prone position as shown in FIGS. 12 and 13.

First portion 590 of each lateral pad 532 includes a first cutout 516 and a first protrusion 518. Second portion 592 of each lateral pad 532 includes a second cutout 520 and a second protrusion 522. First protrusion 518 of each lateral pad 532 extends into a space defined by an associated second cutout 520 and second protrusion 522 of each lateral pad extends into a space defined by the first cutout 516. Portions 590, 592 of lateral pads 532 are configured so that, when patient support frame 502 is oriented to support a patient in a prone position, second portion 592 of each lateral pad 532 includes a downwardly facing edge that is spaced from a complimentarily shaped upwardly facing edge of the associated first portion 590. In the illustrative example, the upwardly facing edge of each portion 590 and the downwardly facing edge of each portion 592 are generally S-shaped.

Patient support frame 502 includes a beam 540 that extends from foot end 28 of first section 510. Head end 24 of beam 540 is coupled to frame member 418 of first section 510 of frame 502 about midway between the opposite sides of first section 510 for pivoting movement about an axis (not shown) that is substantially vertical when frame 502 is oriented to support a patient in the prone position. Coupling assembly 106 includes an arced member 573 that guides and supports an arced member 573 that is coupled to a foot end 28 of beam 540. Arced member 572 is coupled to assembly 106 by a coupling tube 574 that is situated between legs 107 of assembly 106. A pin extends through tube 574 and apertures 124 of legs 107.

Apparatus 500 includes a pair of thigh supports 546 with each thigh support 546 being coupled to a respective side of beam 540 by a respective pivot tube assembly 545. Apparatus 500 also includes a pair of shin supports 548 with each shin support 548 being coupled to a respective of beam 540 by a respective pivot tube assembly 547. In the illustrative embodiment, thigh supports 546 and shin supports 548 each comprises a generally square-shaped flat panel. Optionally, thigh supports 546 and shin supports 546 are padded. Pivot tube assemblies 545 are located at head end 24 of the respective thigh support 546 and pivot tube assemblies 547 are located at foot end 28 of the respective shin support 548.

Each pivot tube assembly 545, 547 includes a handle 549 that is rotated to lock and release the respective tube assembly 545, 547. When pivot tube assemblies 545, 547 are released or unlocked, the respective thigh and shin supports 546, 548 are pivotable about respective axes that are substantially perpendicular to a longitudinal dimension of beam 540. In some embodiments, when pivot tube assemblies 547 are released, the positions of shin supports 548 along beam 540 are individually adjustable. Thus, in the illustrative example, one of shin supports 548 is closer to head end 24 of apparatus 500 than the other. When pivot tube assemblies 545, 547 are locked, the positions of thigh supports 546 and shin supports 548 are fixed relative to beam 540.

In the illustrative embodiment, apparatus 500 includes a resilient knee sleeve 560 that is mounted on beam 540 for linear movement along beam 500. In use, sleeve 560 is positioned to protect a patient's knees from contacting beam 540. In some embodiments, sleeve 560 is a tubular element that totally surrounds beam 540. In other embodiments, a slit or channel is provided at the bottom of sleeve 560 so that sleeve 560 can be slipped onto and off of beam 540. As shown in FIG. 12, thigh straps 552 are provided to secure the patient's thighs to thigh supports 546 and calf straps 554 are provide to secure the patient's lower legs to shin support 548.

Referring now to FIGS. 14-18, a sixth embodiment of a patient support apparatus 600 for supporting a patient during spine surgery includes base unit 20 and a patient support frame 602 that has its head and foot ends 24, 28 coupled to the first and second lift columns 22, 26 by coupling assemblies 104', 106'. Assemblies 104', 106' are substantially the same as assemblies 104, 106 except that assemblies 104', 106' include curved connector bars 605 extending between the ends of respective pairs of legs 107, 109 that are distal from the associated bar 108. Bars 605 serve as handles that are gripped by a user when rotating frame 602 relative to base unit 20.

Frame 602 includes a first section 610 which is generally rectangular in shape. First section 610 is sized to support a patient's torso and includes first and second side rails 612, 614, a head end rail 616, and a foot end rail 618. Rails 612, 614 extend longitudinally between the opposite ends of respective rails 616, 618 and thus, are parallel with the longitudinal dimension of patient support apparatus 600. Rails 612, 614, 616, 618 are sometimes referred to herein as frame members 612, 614, 616, 618.

A coupling tube 622 and coupling pin 625 is used to couple head end 24 of frame 602 to legs 107 of coupling assembly 104' a coupling tube 623 and coupling pin 627 is used to couple foot end 28 of frame 602 to legs 107 of coupling assembly 106'. Pins 625, 627 extend through respective tubes 622, 624 such that opposite ends of pins 625, 627 are received in apertures 124 of legs 107. Tube 622 and associated pin 625 are shown best in FIG. 14. Tube 623 and associated pin 627 are shown best in FIG. 17.

Figure 14:
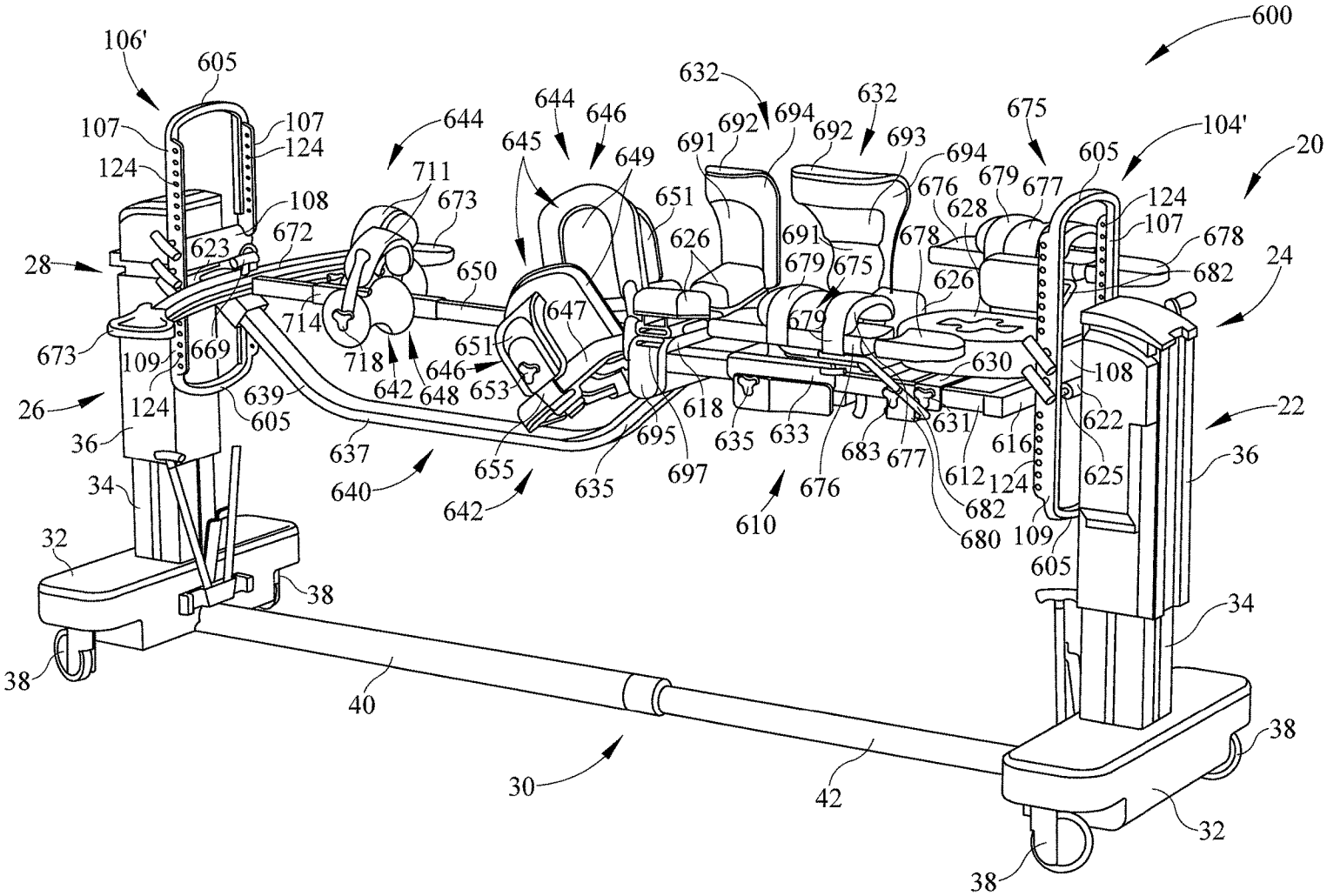
FIG. 14 is a perspective view of a sixth embodiment of a patient support apparatus for supporting a patient during spine surgery showing a base unit having first and second lift columns spaced apart longitudinally with an interconnecting spacer strut, a patient support frame having first and second ends coupled to the first and second lift columns by respective first and second coupling assemblies, the patient support frame having a first section configured to support a torso of a patient, a 3-segment first beam that extends from the first section and that couples to the second lift column by the second coupling assembly, an arced member coupled to a foot end region of the first beam, a second beam situated above the first beam, the second beam including a first end coupled to the first section and a second end that is supported by the arced member, and first and second sets of leg supports on opposite sides of the second beam.
Figure 15:
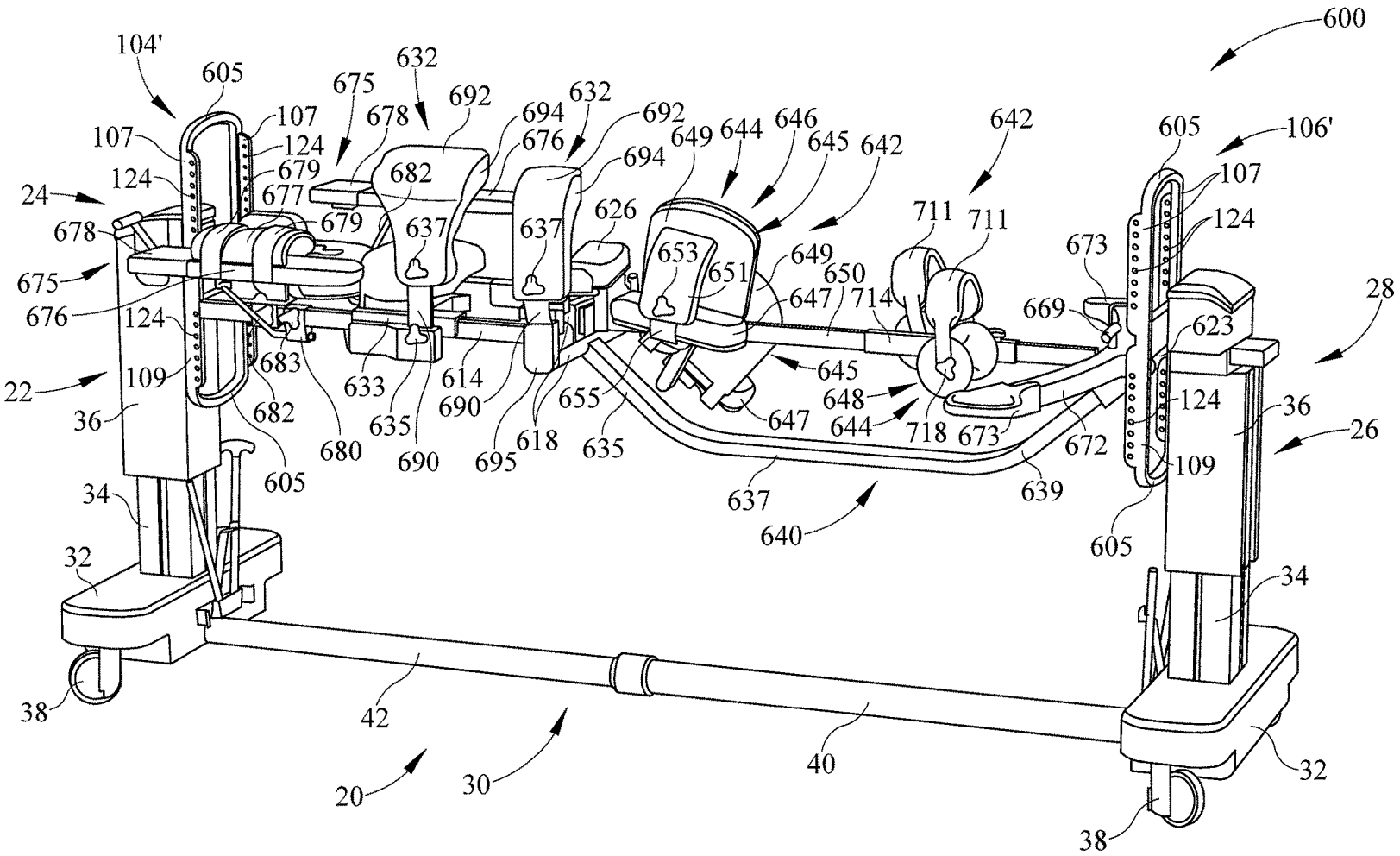
FIG. 15 is another perspective view of the patient support apparatus of FIG. 14 showing the opposite side of the sixth embodiment of the patient support apparatus as compared to the side shown in FIG. 14.
Figure 16:
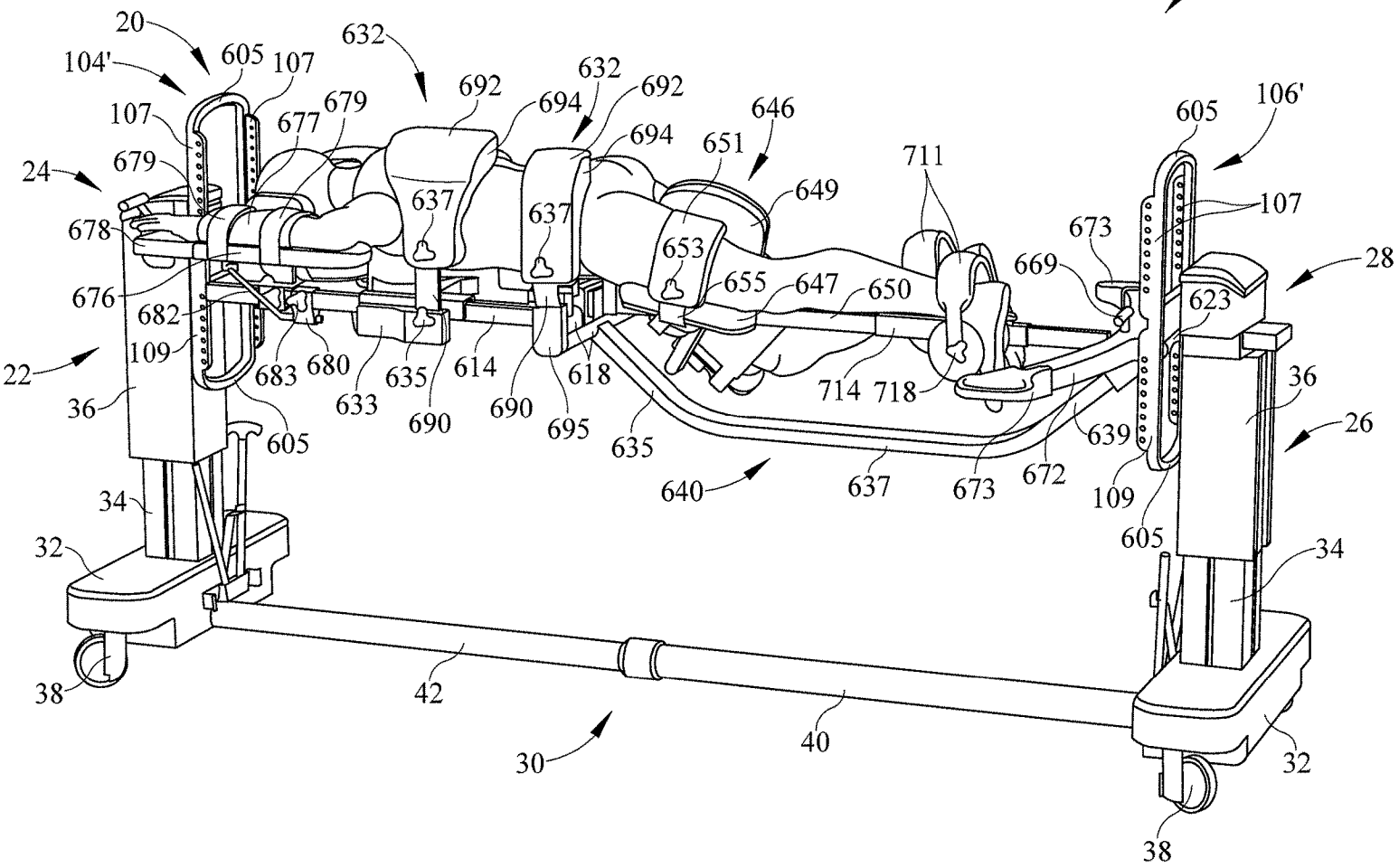
FIG. 16 is a perspective view of the sixth embodiment of the patient support apparatus, similar to FIG. 15, showing a patient supported by the patient support frame in a prone position.

A set of torso supports 626 are coupled to rails 612, 614 and a head support 628 is coupled to a cross member 630 that extends between rails 612, 614 as shown in FIG. 2. Cross member 630 is adjustable along rails 612, 614 in the longitudinal dimension of apparatus 600 when a knob 631 is loosened. In the illustrative example, two of torso supports 626 are coupled to rail 612 and two are coupled to rail 614. Two of the torso support 626 are situated above frame member 618 and serve as hip supports. A pair of lateral supports 632 are coupled to rail 614 adjacent to and laterally outboard of respective torso supports 626. Lateral supports 632 extend upwardly beyond the upper surfaces of torso supports 626 when patient support frame 602 is oriented in a manner to support a patient in a prone position as shown in FIGS. 14-16.

In the illustrative example, the torso supports 626 above frame member 618 and the lateral support 632 adjacent frame member 618 are fixed at those locations relative to first section 610 of frame 602. The other pair of torso supports 626 and lateral support 632 are coupled to a sleeve 633 that is adjustable along the respective rail 612, 614 in the longitudinal dimension of apparatus 600 when an associated knob 635 is loosened. Also, when knob 635 is loosened by a greater extent, the associated lateral support 632 is able to be detached from the respective sleeve 633 and moved to the sleeve 633 on the opposite side of apparatus 600.

Each lateral support 632 includes a bar 690, a panel 692, and a pad 694. Panels 692 are generally rigid and are generally L-shaped so as to curve around the patient's body. Pads 694 fit into the L-shape of the panel and have generally concave inner surfaces 691 for engaging the patient's torso. The lateral support 632 closer to head end 24 of apparatus 600 is a bit wider in the longitudinal dimension of apparatus 600 and has an arm-receiving recess 693 to engage the patient's arm in circumstances in which the patient's arm is placed adjacent their side.

Bar 690 of the wider lateral support 632 is retained in sleeve 633 by a threaded shaft of knob 695 that extends through an aperture or slot provided at the lower end of the bar 690. The threaded shaft of knob 635 extends through bar 690 and sleeve 633 so that its tip engages the respective rail 612, 614 when the knob is tightened, thereby to lock sleeve 633 and the associated torso support 626 and lateral support 632 in place relative to section 610 of frame 602. In the case of the other sleeve 633, the threaded shaft of the associated knob 635 extends only through sleeve 633 to engage the associated rail 612, 614 because there is no lateral support 632 present.

Coupling blocks 695 are provided at the ends of frame member 618 on the opposite sides of frame 602 and each block has a slot 697 (see FIG. 14) that is configured for receipt of bar 690 of an associated lateral support 632 (see FIG. 15). In some embodiments, a press fit between each block 695 and the associated bar 690 retains lateral supports 632 in place relative to first section 610 of frame 602. In other embodiments, a knob similar to knobs 631, 635 is provided adjacent to each block 695 to loosen and tighten relative to bar 690 to lock and release the associated lateral support relative to block 695. Each lateral support 632 includes a knob 637 that is loosened to permit adjustment of the position of the associated panel 692 and pad 694 relative to bar 690 and that is tightened to lock the associated panel 692 and pad 694 in place relative to bar 690. In this way, lateral supports 632 are adjustable to accommodate patient's having torsos of different sizes.

Apparatus 600 has a pair of armboards 675 for supporting the patient's left and right arms. Armboards 675 each include a lower forearm portion 676, an upper forearm portion 677, a hand supporting portion 678, and a pair of straps 679 to secure the patient's arm between respective lower and upper forearm portions 676, 677. Arm boards 675 are coupled to respective rails 612, 614 with respective rail clamps 680 and struts 682 that extend between clamps 680 and lower forearm portion 676. Each rail clamp 680 includes a knob 683 that is used to loosen and tighten the respective clamp 680 relative to rails 612, 614 as the case may be. When knob 683 is loosened, a position of armboard 675 along the respective rail 612, 614 is adjustable and when knob 683 is tightened, armboard 675 are secured in place on the respective rail 612, 614.

Patient support frame 602 includes a first beam 640 that is rigidly coupled at its head end 24 to rail 618 of first section 610 and that is coupled to and supported with respect to second coupling assembly 106' as shown in FIGS. 14-18. Beam 640 is coupled to foot end 28 of first section 610 about midway between opposite sides of first section 610. Beam 640 has first, second and third segments 635, 637, 639 as shown in FIGS. 14-16. When frame 602 is oriented to support a patient in a prone position, segment 635 angles downwardly from rail 618, segment 637 extends substantially horizontally from the lower end of segment 635, and segment 639 extends upwardly from foot end 28 of segment 635. The upper end or foot end 28 of segment 635 is coupled to legs 107 of coupling assembly 106' by tube 623.

An arced member 672 is coupled to the foot end region 28 of beam 640. Handles 673 are provided at the ends of arced member 672 for gripping by a user when rotating frame 602 relative to base unit 20. Frame 602 includes a second beam 650 that has its head end 24 pivotably coupled to the first section 610 and its foot end 28 supported by arced member 672. Beam 650 is being coupled to rail 618 of the first section 610 about midway between opposite sides of the first section 610. In the illustrative embodiment, beam 650 is situated substantially vertically above beam 640 when beam 650 is oriented parallel with the longitudinal dimension of apparatus 600 and frame 602 is oriented to support the patient in the prone position.

Figure 17:
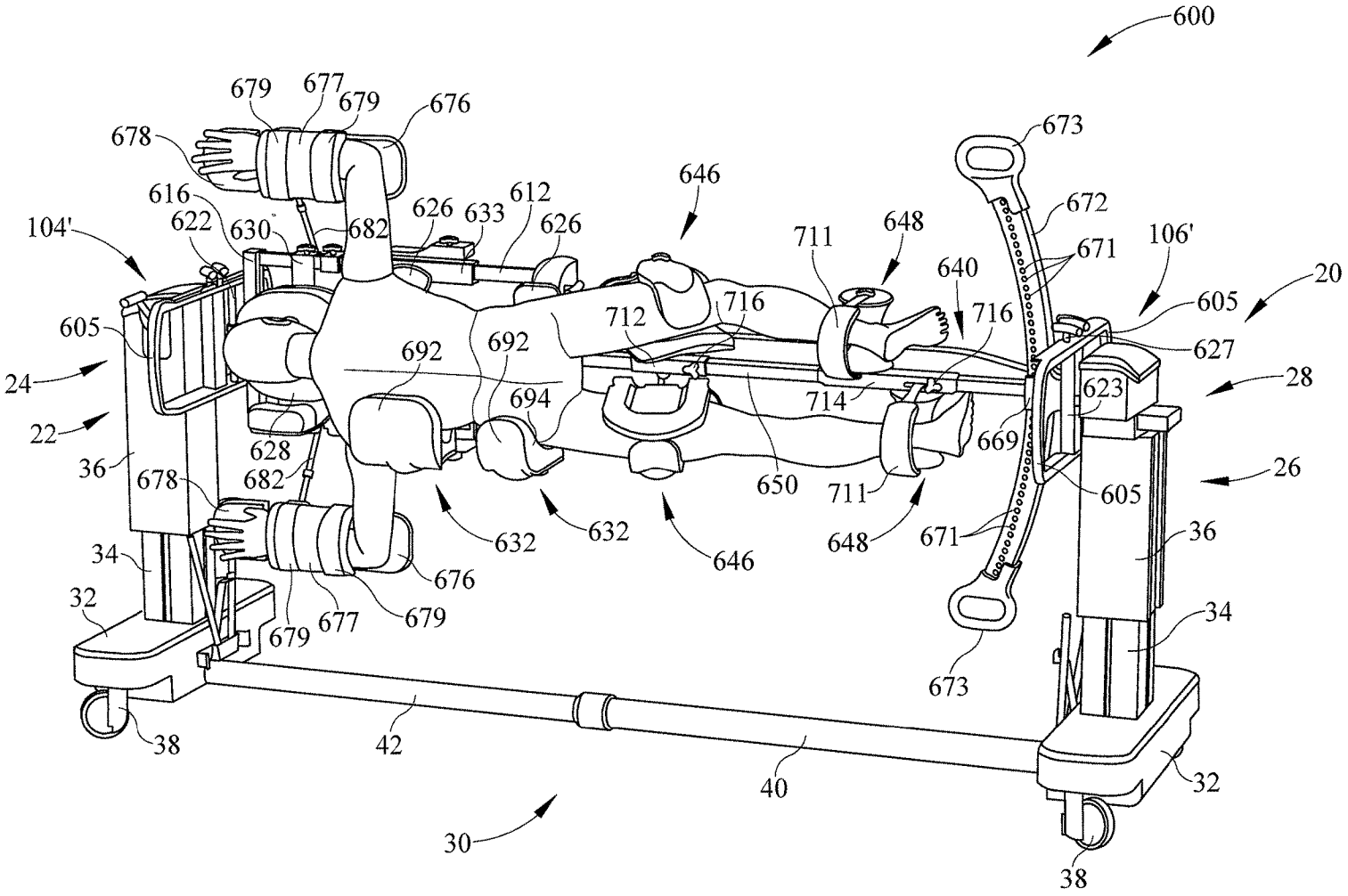
FIG. 17 is a perspective view of the sixth embodiment of the patient support apparatus, similar to FIG. 16, showing the patient support frame rotated from the FIG. 16 orientation by about 90° relative to the first and second lift columns so that the patient is supported by the patient support frame in a lateral position.
Figure 18:
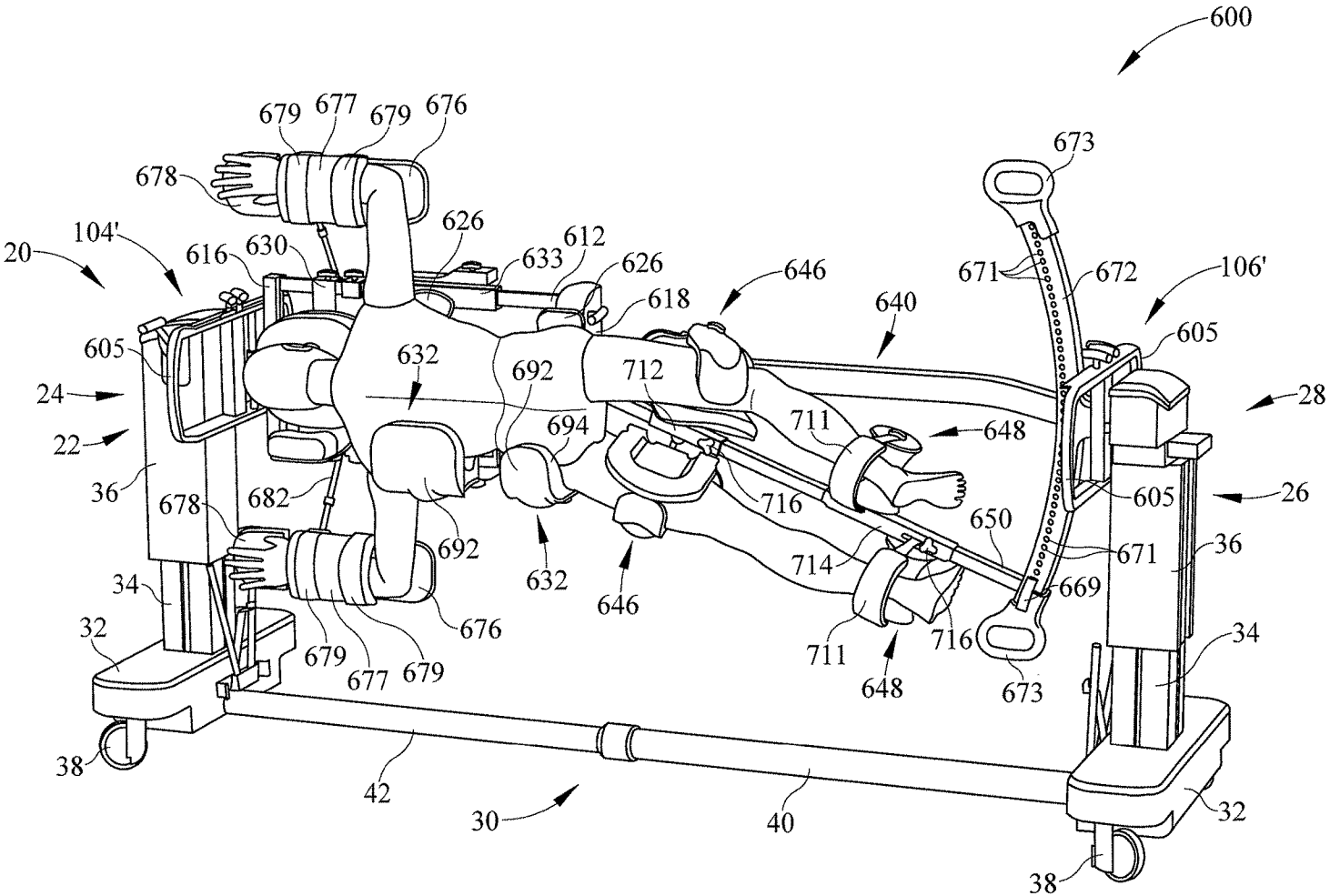
FIG. 18 is a perspective view of the sixth embodiment of the patient support apparatus, similar to FIG. 17, showing the second beam and the first and second sets of leg supports carried by the second beam rotated relative to the first section of the patient support frame so that the second end of the second beam is moved to a lower end of the arced member.

Beam 650 is pivotable relative to rail 618 and foot end 28 of beam 650 moves along arced member 672 as beam 650 pivots. As shown in FIGS. 17 and 18, arced member 672 has a series of apertures 671. A T-shaped pull pin 669 is provided for locking and releasing foot end 28 of beam 650 relative to arced track 672. Pin 669 is inserted through a desired one of apertures 671 and through a hole provided at the foot end 28 of beam 650 to lock beam 650 in place relative to arced member 672. To pivot beam 650 along member 672, pin 669 is detached from member 672.

Patient support apparatus 600 includes a first set of leg supports 642 located adjacent a first side of beam 640 and a second set of leg supports 644 located adjacent a second side of beam 640. First set and second set of leg supports 1642, 1644 are movable relative to beam 640 and relative to first section 610 of the patient support frame 602 to support first and second legs of the patient in a plurality of positions. The first set of leg supports 642 are movable independently of the second set of leg supports 644 so that the patient's right and left legs can be placed in different positions. Leg supports 642, 644 each include a thigh support 646 and an ankle support 648.

In some embodiments, thigh supports 646 are pivotably coupled to second beam 650 and ankle supports 648 are slidably coupled to second beam 650. Each thigh support 646 includes an L-shaped pad 645 having a bottom portion 647 and an inner thigh engaging portion 649 that extends upwardly from the bottom portion 647 when patient support frame 602 is oriented to support the patient in a prone position. In the illustrative embodiment, each thigh support 646 includes an outer thigh engaging portion 651 coupled to a respective bottom portion 647. Outer thigh engaging portions 651 are each adjustable relative to the respective L-shaped pad 645 by loosening a knob 653 which allows repositioning of portion 651 along a corresponding bar 655 to accommodate patient legs of different sizes.

In the illustrative embodiment, ankle supports 648 each include a generally cylindrically shaped pad with a concave outer surface. Straps 711 are provided on each ankle support 648 to secure a patient's leg to the respective ankle support. Frame 602 includes first and second tubes 712, 714 mounted on beam 650 and slidable relative to beam 650 when a respective knob 716 (see FIGS. 17 and 18) is loosened for repositioning therealong. Thigh supports 646 are pivotably coupled to opposite sides of tube 712. Ankle supports 648 extend laterally from tube 714 and are supported relative to tube 714 in a cantilevered manner. Ankle supports 648 are slidably repositionable with respect to tube 714 when a knob 718 is loosened.

In use, each of apparatuses 100, 200, 300, 400, 500, 600 are configured for use during complex prone surgeries and lateral (MIS) approaches. Apparatuses 100, 200, 300, 400, 500, 600 each have the ability to hold the patient in the prone position and the respective leg supports are rotatable about the patient's sacrum to correct scoliotic curvature for corrective surgery. Each of apparatuses 100, 200, 300, 400, 500, 600 have respective frames 102, 202, 302, 402, 502, 602 with the ability to rotate by about 90° with respect to the associated base unit 20 (see FIG. 17 with regard to apparatus 600) and to drop the patient's leg to expose the L4-L5 disk space (see FIG. 18 with regard to apparatus 600).

Although certain illustrative embodiments have been described in detail above, many embodiments, variations and modifications are possible that are still within the scope and spirit of this disclosure as described herein and as defined in the following claims.

The invention claimed is:

1. A patient support apparatus for spine surgery, the patient support apparatus comprising a first lift column, a second lift column spaced apart from the first lift column in a longitudinal dimension of the patient support apparatus, a patient support frame extending longitudinally between the first and second lift columns, the patient support frame comprising a first section to support a torso of a patient, the first section having spaced apart first and second rails extending generally parallel with the longitudinal dimension of the patient support apparatus, the first section having a head end region coupled to the first lift column by a first coupling assembly, the patient support frame having a first beam that extends from the first section and that couples to the second lift column by a second coupling assembly, the first beam being coupled to a foot end region of the first section about midway between opposite sides of the first section, a first set of leg support pads coupled to patient support frame and located on a first side of the first beam, the first set of leg support pads including a first thigh pad and a first ankle pad, and a second set of leg support pads coupled to the patient support frame and located on a second side of the first beam, the second set of leg support pads including a second thigh pad and a second ankle pad.

2. The patient support apparatus of claim 1, the patient support frame further comprising a second beam extending from the second coupling assembly in a cantilevered manner so as to terminate at a free end that is spaced from the first section of the patient support frame, the second beam being situated above the first beam, the first and second ankle pads being supported by the second beam on respective first and second sides thereof.

3. The patient support apparatus of claim 2, wherein the first and second ankle pads extend laterally from respective first and second sides of the second beam and are each supported relative to the second beam in a cantilevered manner.

4. The patient support apparatus of claim 3, wherein the second beam has first and second slots along the first and second sides and wherein the first and second ankle pads each have a respective support rod that extends into the respective first and second slot.

5. The patient support apparatus of claim 3, wherein the first and second ankle pads are each independently adjustable along a length of the second beam.

6. The patient support apparatus of claim 2, wherein, when the patient support frame is in a horizontal position supporting the patient in a prone position, the first beam comprises a first segment that angles downwardly with respect to the foot end region of the first section, a second segment that extends horizontally from a lower end of the first segment, and a third segment that angles upwardly from the second segment to the second coupling assembly.

7. The patient support apparatus of claim 6, wherein the second coupling assembly includes an arced member that supports the foot end regions of the first and second beams, the patient support frame includes a first laterally extending member and a second laterally extending member coupled to the first laterally extending member for pivoting movement about an axis, the first segment of the first beam being coupled to the second laterally extending member, and the foot end regions of the first and second beams traveling along the arced member as the first and second beams pivot with the second laterally extending member about the axis.

8. The patient support apparatus of claim 7, wherein the first and second laterally extending members serve as a hip support for the patient supported by the patient support frame in a prone position.

9. The patient support apparatus of claim 1, further comprising first and second struts coupled to the first section, the first thigh pad and the first ankle pad being coupled to the first strut, the second thigh pad and the second ankle pad being coupled to the second strut, and wherein at least one of the first and second struts includes a first strut portion and a second strut portion that articulates at a joint relative to the first strut portion.

10. The patient support apparatus of claim 9, wherein the first thigh pad is coupled to the first strut portion and the first ankle pad is coupled to the second strut portion.

11. The patient support apparatus of claim 10, further comprising a knee pad coupled to the at least one of the first and second struts adjacent the joint.

12. The patient support apparatus of claim 1, further comprising first and second struts coupled to the first section, the first thigh pad and the first ankle pad being coupled to the first strut, the second thigh pad and the second ankle pad being coupled to the second strut, and wherein at least one of the first and second struts includes a first strut portion and a second strut portion that telescopically extends and retracts relative to the first strut portion.

13. The patient support apparatus of claim 12, wherein the first thigh pad is coupled to the first strut portion and the first ankle pad is coupled to the second strut portion.

14. The patient support apparatus of claim 13, further comprising a knee pad coupled to the at least one of the first and second struts between the respective first and second thigh and first and second ankle pads.

15. The patient support apparatus of claim 1, further comprising a set of torso supports coupled to one of the first and second rails, a pair of lateral supports coupled to the other of the first and second rails, each lateral support of the pair of lateral supports extending upwardly beyond upper surfaces of the torso supports when the patient is supported on the torso supports in a prone position, the lateral supports supporting a side of the patient's torso when the patient support frame is rotated with respect to the first and second lift columns to place the patient in a lateral position.

16. The patient support apparatus of claim 15, wherein the pair of lateral supports each include a first support portion that couples to one of the first and second rails and a second support portion that adjustably moves toward and away from the first support portion to accommodate patients of different sizes.

17. The patient support apparatus of claim 16, wherein each lateral support of the pair of lateral supports includes a bar that telescopically couples the second support portion to the first support portion.

18. The patient support apparatus of claim 16, wherein the first support portion of each lateral support of the pair of lateral supports has a torso supporting surface and wherein the second support portion of each lateral support of the pair of lateral supports extends over the torso supporting surface when the lateral supports extend upwardly such that the first and second support portions are configured to cradle a side of the patient's torso.

19. The patient support apparatus of claim 9, further comprising first and second collars that couple the first and second thigh pads, respectively, to the first and second struts, respectively, each of the first and second collars being movable along a length of the first and second struts, respectively.

20. The patient support apparatus of claim 19, wherein the first and second collars are lockable to the first and second struts, respectively, to prevent movement of the first and second thigh pads relative to the first and second struts, respectively.

* * * * *